US009541319B2

(12) United States Patent
Morimoto et al.

(10) Patent No.: US 9,541,319 B2
(45) Date of Patent: Jan. 10, 2017

(54) AIR-CONDITIONING APPARATUS

(75) Inventors: Hiroyuki Morimoto, Tokyo (JP); Koji Yamashita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 522 days.

(21) Appl. No.: 13/885,752

(22) PCT Filed: Jan. 20, 2011

(86) PCT No.: PCT/JP2011/000297

§ 371 (c)(1),
(2), (4) Date: May 16, 2013

(87) PCT Pub. No.: WO2012/098584

PCT Pub. Date: Jul. 26, 2012

(65) Prior Publication Data

US 2013/0227977 A1 Sep. 5, 2013

(51) Int. Cl.

| | |
|---|---|
| ***F25B 49/00*** | (2006.01) |
| ***F25B 49/02*** | (2006.01) |
| ***F25B 13/00*** | (2006.01) |
| *F25B 25/00* | (2006.01) |

(52) U.S. Cl.

CPC ..... *F25B 49/02* (2013.01); *F25B 13/00* (2013.01); *F25B 49/005* (2013.01); *F25B 25/005* (2013.01); *F25B 2313/023* (2013.01); *F25B 2313/0272* (2013.01); *F25B 2313/02732* (2013.01); *F25B 2313/02741* (2013.01); *F25B 2400/08* (2013.01); *F25B 2400/121* (2013.01); *F25B 2500/222* (2013.01)

(58) Field of Classification Search

CPC ... F25B 49/02; F25B 49/005; F25B 2400/121; F25B 2313/02732; F25B 2400/02732

See application file for complete search history.

(56) References Cited

U.S. PATENT DOCUMENTS

| | | | | |
|---|---|---|---|---|
| 4,720,982 | A * | 1/1988 | Shimizu et al. | 62/204 |
| 4,766,735 | A * | 8/1988 | Gotou | 62/175 |
| 4,825,908 | A * | 5/1989 | Tsuchihashi et al. | 137/625.43 |
| 5,477,913 | A * | 12/1995 | Polk et al. | 165/11.1 |
| 6,270,055 | B1 * | 8/2001 | Szeteli et al. | 251/335.3 |

(Continued)

FOREIGN PATENT DOCUMENTS

| | | |
|---|---|---|
| JP | 61-74078 U | 5/1986 |
| JP | 62-77769 U | 5/1987 |

(Continued)

OTHER PUBLICATIONS

Kawakatsu et al., Refrigeration Device, Jun. 4, 2009, WO2009069258A1, Whole Document.*

(Continued)

*Primary Examiner* — Larry Furdge

(74) *Attorney, Agent, or Firm* — Posz Law Group, PLC

(57) ABSTRACT

An air-conditioning apparatus directly detects leakage of a plurality of types of refrigerant by computing refrigerant concentrations, and ensure safety. On the basis of calibration curve information, a computing device computes the concentration of heat source side refrigerant in a heat medium relay unit from detected information received from a concentration detecting device.

13 Claims, 8 Drawing Sheets

(56) References Cited

U.S. PATENT DOCUMENTS

| | | | | |
|---|---|---|---|---|
| 2002/0178738 | A1* | 12/2002 | Taira et al. | 62/129 |
| 2004/0139755 | A1* | 7/2004 | Han Park | F25B 5/02 62/199 |
| 2005/0103029 | A1* | 5/2005 | Kawahara et al. | 62/126 |
| 2006/0005556 | A1* | 1/2006 | Hirota | 62/216 |
| 2009/0292399 | A1* | 11/2009 | Nagase et al. | 700/282 |

FOREIGN PATENT DOCUMENTS

| | | | | |
|---|---|---|---|---|
| JP | 07-055267 | A | | 3/1995 |
| JP | H0755267 | A | * | 3/1995 |
| JP | H11-037619 | A | | 2/1999 |
| JP | 11-159924 | A | | 6/1999 |
| JP | 2000-320936 | A | | 11/2000 |
| JP | 2000-346497 | A | | 12/2000 |
| JP | 2002-195718 | A | | 7/2002 |
| JP | 2002-372317 | A | | 12/2002 |
| JP | 2004-116929 | A | | 4/2004 |
| JP | 2005-241052 | A | | 9/2005 |
| JP | 2005-291679 | A | | 10/2005 |
| JP | 2008-249234 | A | | 10/2008 |
| JP | WO2009069258 | A1 | * | 6/2009 |
| JP | WO2009133644 | A1 | * | 11/2009 |
| WO | 2010/050007 | A1 | | 5/2010 |

OTHER PUBLICATIONS

Shinichi et al., Air Conditioner, Nov. 5, 2009, WO2009133644A1, Whole Document.*

Shizuo et al., Air Conditioner, Mar. 3, 1995, JPH0755267A, Whole Document.*

Extended European Search Report dated Jul. 25, 2014 issued in corresponding EP patent application No. 11856610.8.

Office Action mailed Mar. 18, 2014 in corresponding JP Application No. 2012-553462 (English translation).

Office Action mailed Dec. 2, 2014 issued in corresponding JP patent application No. 2012-553462 (and English translation).

International Search Report of the International Searching Authority mailed Apr. 26, 2011 for the corresponding international application No. PCT/JP2011/000297 (with English translation).

Japanese Office Action mailed on Jul. 7, 2015 in the corresponding JP application No. 2012-553462. ( English translation attached ).

* cited by examiner

AIR-CONDITIONING APPARATUS

CROSS REFERENCE TO RELATED APPLICATION

This application is a U.S. national stage application of International Patent Application No. PCT/JP2011/000297 filed on Jan. 20, 2011.

TECHNICAL FIELD

The present invention relates to an air-conditioning apparatus applied to a multi-air-conditioning system for a building, for example.

BACKGROUND

Hitherto, in an air-conditioning apparatus such as a multi-air-conditioning system for a building, a refrigerant radiates or absorbs heat as a result of the refrigerant being circulated between an outdoor unit, or in other words heat source, disposed outside the building, and an indoor unit disposed inside the building. The air-conditioned space is thus cooled or heated by the heated or cooled air. In such a multi-air-conditioning system for a building, multiple indoor units are connected, and there is often a mixture of stopped indoor units and running indoor units. The refrigerant pipes that connect the outdoor units to the indoor units may also reach up to a maximum of 100 m. As the refrigerant pipes become longer, large quantities of refrigerant fill the refrigeration cycle.

The indoor units of such a multi-air-conditioning system for a building are typically disposed and used in indoor spaces where people are present (such as office spaces, rooms, or stores). At this point, if for some reason the refrigerant leaks out from an indoor unit disposed in an indoor space, the refrigerant poses a major problem from the perspective of its influence on the human body and safety, as a refrigerant may be combustible or toxic depending on type. In addition, even assuming that the refrigerant is not harmful to the human body, the refrigerant leakage is expected to lower the oxygen concentration in the indoor space and exert an adverse influence on the human body. Thus, technology configured to stop the system (stop compressor operation) when the refrigerant leaks out from the refrigeration cycle has been disclosed (see Patent Literature 1, for example).

CITATION LIST

Patent Literature

Patent Literature 1: Japanese Unexamined Patent Application Publication No. 2000-320936 (pp. 5, etc.)

SUMMARY OF INVENTION

Technical Problem

Meanwhile, global warming concerns recently have led to action to restrict the use of HFC refrigerants with a high global warming potential (such as R410A, R-404A, R407C, and R-134a), and air-conditioning apparatus using refrigerants with a low global warming potential (such as HFO1234yf, R32, HC, and carbon dioxide) are being proposed. In addition, since large quantities of refrigerant are required even in the case of using combustible refrigerants (such as HFO1234yf, HFO1234ze, R32, refrigerant mixtures containing R32 and HFO1234yf, refrigerant mixtures containing at least one of the above refrigerants as a component, and HC) or carbon dioxide as the refrigerant in a multi-air-conditioning system for a building, it is necessary to adopt countermeasures in the event of a refrigerant leak in an indoor space.

The technology described in Patent Literature 1 uses carbon dioxide as a refrigerant, and is configured to stop the system in the case where a carbon dioxide refrigerant leak occurs. However, leakage of the carbon dioxide refrigerant used as the refrigerant is detected indirectly on the basis of only the refrigeration cycle pressure. Depending on the state of the refrigeration cycle, a malfunction in detecting a refrigerant leak is a possibility. Furthermore, the technology is problematic in that no consideration is made regarding how much leakage has an adverse effect on the human body. The technology is additionally problematic in that the discussion stops at the detection of a carbon dioxide leak only as a refrigerant leak, and cannot be applied to other refrigerants.

SUMMARY

The present invention, being devised in order to solve the above problem, takes as an object to provide an air-conditioning apparatus capable of directly detecting leakage of multiple types of refrigerants by computing refrigerant concentrations, and ensure safety.

An air-conditioning apparatus according to the present invention includes: an outdoor unit equipped with a compressor that compresses heat source side refrigerant, and a heat source side heat exchanger that exchanges heat between outdoor air and the heat source side refrigerant; a heat medium relay unit equipped with a heat exchanger related to heat medium that exchanges heat between the heat source side refrigerant and the heat medium, an expansion device that depressurizes the heat source side refrigerant, and a pump that pumps the heat medium by pressure; an indoor unit equipped with a use side heat exchanger that exchanges heat between indoor air and the heat medium; and a concentration detecting device that detects and computes a refrigerant concentration, the refrigerant concentration being the concentration of heat source side refrigerant inside or near the heat medium relay unit. The compressor, the heat source side heat exchanger, the refrigerant flow path in the heat exchanger related to heat medium, and the expansion device are connected by refrigerant pipes to form a refrigerant circuit through which the heat source side refrigerant circulates. The heat medium flow path in the heat exchanger related to heat medium, the pump, and the use side heat exchanger are connected by heat medium pipes to form a heat medium circuit through which the heat medium circulates. The concentration detecting device includes a detecting unit capable of detecting the refrigerant concentration of a plurality of types of heat source side refrigerants from an electrical resistance that changes in accordance with the refrigerant concentration, and is capable of computing the refrigerant concentration of a plurality of types of heat source side refrigerants on the basis of correlation information between a resistance value of the detecting unit and the refrigerant concentration near the detecting unit.

According to the present invention, it becomes possible to precisely detect leaks in heat source side refrigerant inside or near a heat medium relay unit, and greatly improve the safety of an air-conditioning apparatus.

DETAILED DESCRIPTION

Embodiment 1

Configuration of Air-Conditioning Apparatus

Figure 1:
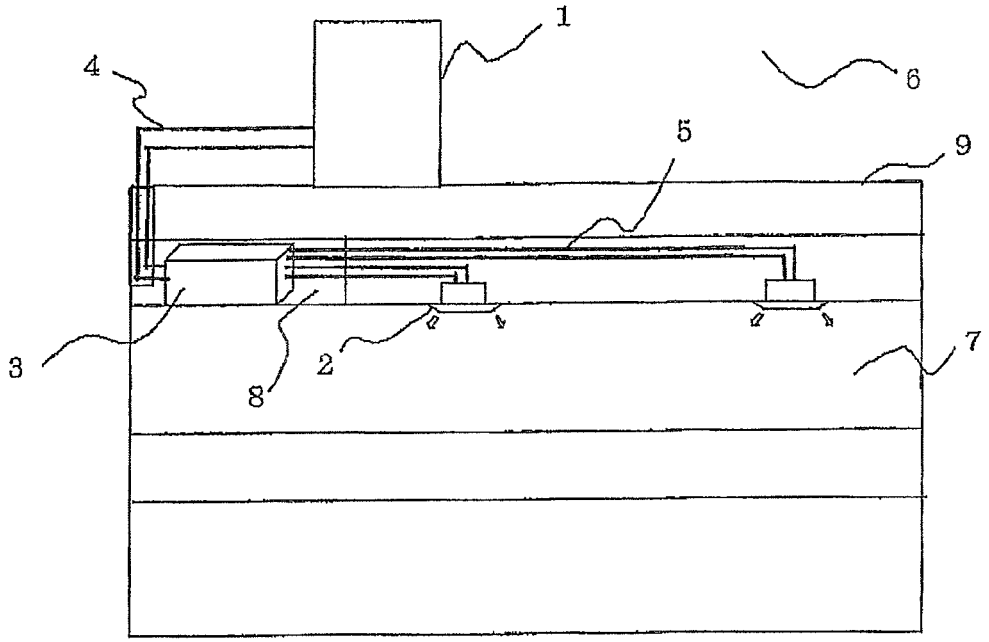
FIG. 1 is a diagram illustrating an exemplary installation of an air-conditioning apparatus according to Embodiment 1 of the present invention.

FIG. 1 is a diagram illustrating an exemplary installation of an air-conditioning apparatus according to Embodiment 1 of the present invention.

With the air-conditioning apparatus according to Embodiment 1, each indoor unit is capable of freely selecting the cooling operation or the heating operation as the operating mode by utilizing refrigeration cycles (the refrigerant circuit A and the heat medium circuit B described later) that circulate refrigerant (heat source side refrigerant and heat medium). In addition, the air-conditioning apparatus according to present invention implements a technique of indirectly utilizing heat source side refrigerant. In other words, the air-conditioning apparatus is configured to transfer cooling energy or heating energy stored in the heat source side refrigerant to the heat medium, the heat medium being a refrigerant that differs from the heat source side refrigerant, and cools or heats an air-conditioned space with the cooling energy or heating energy stored in the heat medium.

As illustrated in FIG. 1, the air-conditioning apparatus according to Embodiment 1 includes one outdoor unit 1 which is the heat source, multiple indoor units 2, and a heat medium relay unit 3 interposed between the outdoor unit 1 and the indoor units 2. The outdoor unit 1 and the heat medium relay unit 3 are connected by refrigerant pipes 4 that flows the heat source side refrigerant. The heat medium relay unit 3 and the indoor units 2 are connected by heat medium pipes 5 that flows the heat medium. Also, cooling energy or heating energy generated at the outdoor unit 1 is transferred to the indoor units 2 via the heat medium relay unit 3.

The outdoor unit 1 is typically installed in an outdoor space 6, which is a space outside a building or other building 9 (such as a roof), and provides cooling energy or heating energy to the indoor units 2 via the heat medium relay unit 3.

Note that although FIG. 1 illustrates the case of the outdoor unit 1 being installed in the outdoor space 6 as an example, the configuration is not limited thereto. For example, the outdoor unit 1 may also be installed in an enclosed space such as a ventilated machine room, and may be installed inside the building 9 insofar as waste heat can be exhausted outside the building 9 by an exhaust duct. Alternatively, the outdoor unit 1 may be installed inside the building 9 in the case of using a water-cooled outdoor unit 1. Installing the outdoor unit 1 in such locations is not particularly problematic.

The indoor units 2 are disposed at positions from which the indoor units 2 can supply cooled air or heated air to an indoor space 7, which is a space inside the building 9 (such as a room), and provide cooled air or heated air to the indoor space 7 to be air-conditioned.

Note that although FIG. 1 illustrates the case where the indoor units 2 are ceiling cassettes as an example, the configuration is not limited thereto, and the indoor units 2 may be of any type, such as ceiling-concealed or ceiling-suspended units, insofar as the indoor units 2 are capable of expelling heated air or cooled air into the indoor space 7 directly or via means such as ducts.

The heat medium relay unit 3 is configured as a separate housing from the outdoor unit 1 and the indoor units 2 and is installable in separate location from the outdoor space 6 and the indoor space 7, and is connected to the outdoor unit 1 and the indoor units 2 by the refrigerant pipes 4 and the heat medium pipes 5, respectively. The heat medium relay unit 3 also transfers cooling energy or heating energy supplied from the outdoor unit 1 to the indoor units 2, or more specifically, exchanges heat between a heat source side refrigerant at the outdoor unit 1 and a heat medium (such as water or antifreeze) at the indoor units 2 that differs from the heat source side refrigerant. Additionally, FIG. 1 illustrates an example in which the heat medium relay unit 3, although inside the building 9, is installed in a space 8 which is a separate space from the indoor space 7, such as above the ceiling. Also, since the heat medium relay unit 3 is provided close to the indoor units 2 installed in the indoor space 7, the pipes for the circuit that flows the heat medium (the heat medium circuit B described later) can be shortened. In so doing, the heat medium pumping power in the heat medium circuit B may be reduced, leading to energy saving.

Note that although the heat medium relay unit 3 is installed in a space 8 as illustrated in FIG. 1, the configuration is not limited thereto, and the heat medium relay unit 3 may also be installed in a shared space containing an elevator, for example.

In addition, although the heat medium relay unit 3 is installed close to the indoor units 2 as mentioned above, the configuration is not limited thereto, and the heat medium relay unit 3 may also be installed in the vicinity of the outdoor unit 1. In this case, however, the heat medium pumping will require large electric power if the distance from the heat medium relay unit 3 to the indoor units 2 is rather long, and thus care must be taken not to squander the energy-saving advantages.

There are two refrigerant pipes 4, and the outdoor unit 1 is connected to the heat medium relay unit 3 by means of these two refrigerant pipes 4. Also, the heat medium pipes 5 connect the heat medium relay unit 3 and each of the indoor units 2 is connected to the heat medium relay unit 3 with the two heat medium pipes 5. By using two pipes (the refrigerant pipes 4 and the heat medium pipes 5) to connect each unit (the outdoor unit 1, the indoor units 2, and the heat medium relay unit 3) in the air-conditioning apparatus according to Embodiment 1, achieving facilitated installation work.

However, the number of connected outdoor units 1, indoor units 2, and heat medium relay units 3 is not limited to the numbers illustrated in FIG. 1, and may be determined according to the building 9 where the air-conditioning apparatus according to Embodiment 1 is installed.

Furthermore, in the drawings hereinafter, including FIG. 1, the relative sizes of respective structural members are not limited to what is illustrated, which may differ from actual sizes in some cases.

Figure 2:
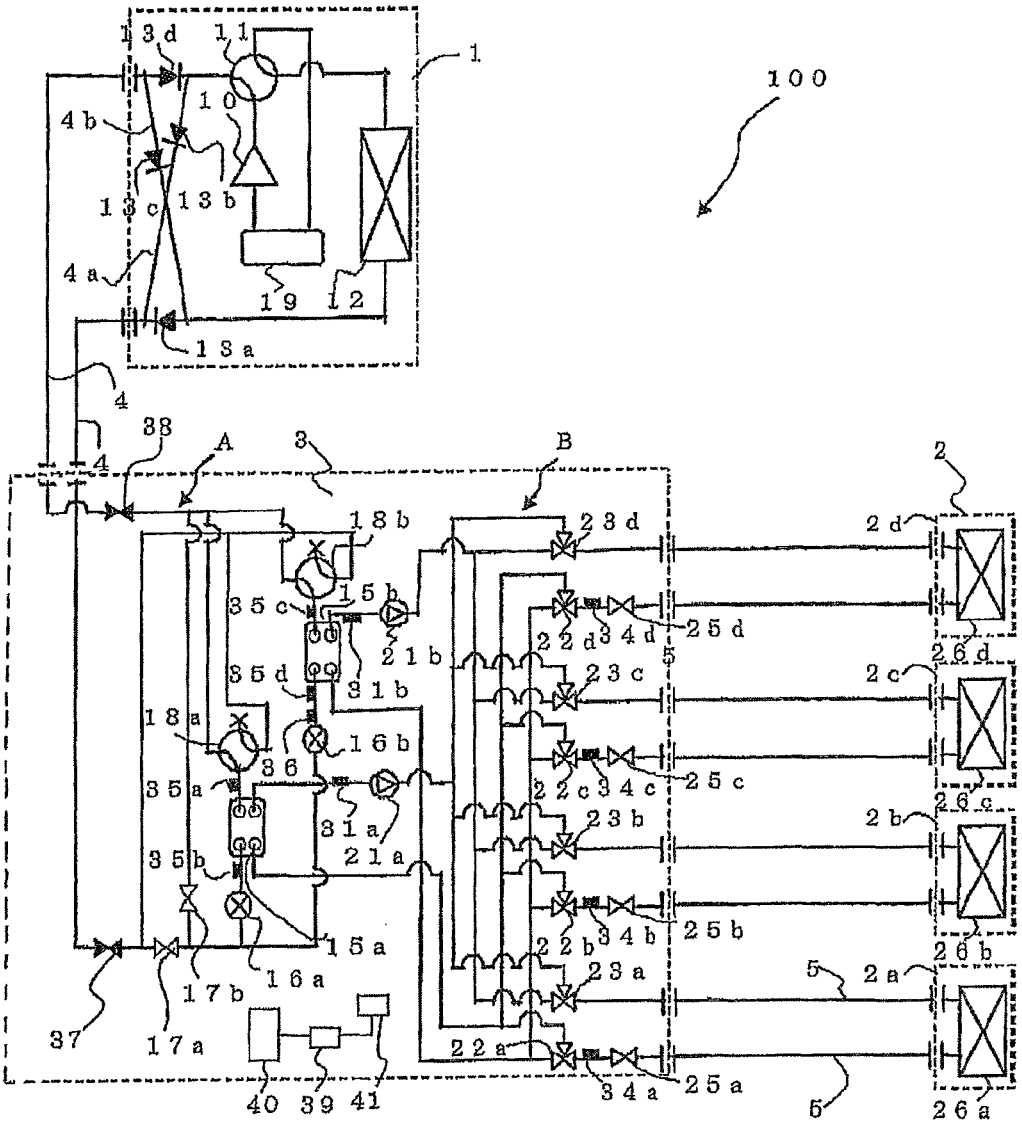
FIG. 2 is a diagram illustrating an exemplary circuit configuration of an air-conditioning apparatus (hereinafter designated the air-conditioning apparatus 100) according to Embodiment 1 of the present invention.

FIG. 2 is a diagram illustrating an exemplary circuit configuration of an air-conditioning apparatus (hereinafter designated the air-conditioning apparatus 100) according to Embodiment 1 of the present invention. Hereinafter, a detailed configuration of the air-conditioning apparatus 100 will be described with reference to FIG. 2.

As illustrated in FIG. 2, the outdoor unit 1 and the heat medium relay unit 3 are connected by the two refrigerant pipes 4 as mentioned above. The refrigerant pipes 4 are respectively connected to a heat exchanger related to heat medium 15*a* and a heat exchanger related to heat medium 15*b* provided in the heat medium relay unit 3 by internal refrigerant pipes in the heat medium relay unit 3. Herein, the above-mentioned refrigerant circuit A refers to a refrigerant circuit made up of equipment connected by refrigerant pipes, including the refrigerant pipes 4 that connect the outdoor unit 1 to the heat medium relay unit 3, which circulate the heat source side refrigerant that exchanges heat with a heat medium respectively in the heat exchanger related to heat medium 15*a* and the heat exchanger related to heat medium 15*b* inside the heat medium relay unit 3. Specifically, the refrigerant circuit A includes a compressor 10, a first refrigerant flow switching device 11, a heat source side heat exchanger 12, a first shutoff device 37, opening and closing devices 17, second refrigerant flow switching devices 18, the refrigerant passages of the heat exchangers related to heat medium 15, expansion devices 16, and an accumulator 19 described later, which are connected by refrigerant pipes. In addition, the heat source side refrigerant that circulates through the refrigerant circuit A is not particularly limited, and although there has been action recently to restrict the use of HFC refrigerants with a high global warming potential (such as R410A, R-404A, R407C, and R-134a), usage thereof is not restricted in the air-conditioning apparatus 100 according to Embodiment 1. Obviously, refrigerants with a low global warming potential (such as HFO1234yf, HFO1234ze, R32, refrigerant mixtures containing R32 and HFO1234yf, refrigerant mixtures containing at least one of the above refrigerants as a component, HC, and carbon dioxide) may also be used. Another single refrigerant or refrigerant mixture that works in a supercritical state similarly to carbon dioxide (for example, a mixture of carbon dioxide and diethyl ether) may also be used. The relative connections among the above equipment constituting the refrigerant circuit A will be described in detail later.

In addition, the heat medium relay unit 3 and the indoor units 2 are connected by the two heat medium pipes 5 as mentioned above. The heat medium pipes 5 are respectively connected to the heat exchanger related to heat medium 15*a* and the heat exchanger related to heat medium 15*b* provided in the heat medium relay unit 3 by the internal heat medium pipes in the heat medium relay unit 3. Herein, the heat medium circuit B described earlier refers to a heat medium circuit made up of equipment connected by heat medium pipes, including the heat medium pipes 5 that connect the heat medium relay unit 3 to each of the indoor units 2, which circulate the heat medium that exchanges heat with heat source side refrigerant respectively in the heat exchanger related to heat medium 15*a* and the heat exchanger related to heat medium 15*b* inside the heat medium relay unit 3. Specifically, the heat medium circuit B is made up of the heat medium flow paths of the heat exchangers related to heat medium 15, pumps 21, first heat medium flow switching devices 22, heat medium flow control devices 25, use side heat exchangers 26, and second heat medium flow switching devices 23 described later, which are connected by heat medium pipes. In addition, the heat medium that circulates through the heat medium circuit B is not particularly limited, and substances such as brine (antifreeze), water, mixtures of brine and water, or mixtures of water and a highly anticorrosive additive may be used. Using such a heat medium contributes to improved safety even if the heat medium leaks into the indoor space 7 via the indoor units 2, because a highly safe substance is used as the heat medium. The relative connections among the above equipment constituting the heat medium circuit B will be described in detail later.

Hereinafter, a configuration of the outdoor unit 1, the indoor units 2, and the heat medium relay unit 3 will be described in detail with reference to FIG. 2.

(Configuration of Outdoor Unit 1)

The outdoor unit 1 includes a compressor 10, a first refrigerant flow switching device 11 such as a four-way valve, a heat source side heat exchanger 12, and an accumulator 19, which are connected in series by refrigerant pipes. The outdoor unit 1 also includes a first connecting pipe 4*a*, a second connecting pipe 4*b*, a check valve 13*a*, a check valve 13*b*, a check valve 13*c*, and a check valve 13*d*. As described later, providing the first connecting pipe 4*a*, the second connecting pipe 4*b*, the check valve 13*a*, the check valve 13*b*, the check valve 13*c*, and the check valve 13*d* makes it possible to keep the flow of refrigerant circulating into the heat medium relay unit 3 via the refrigerant pipes 4 in a fixed direction, regardless of the operation requested by the indoor units 2.

The compressor 10 suctions heat source side refrigerant in a gaseous state and compresses the heat source side refrigerant into a high temperature, high pressure state. The compressor 10 may include a variable-capacity inverter compressor, for example.

The first refrigerant flow switching device 11 switches between a flow of heat source side refrigerant during a heating operation (the heating only operating mode and the heating main operating mode described later) and a flow of heat source side refrigerant during a cooling operation (the cooling only operating mode and the cooling main operating mode described later).

The heat source side heat exchanger 12 functions as an evaporator during the heating operation, functions as a radiator (gas cooler) during the cooling operation, and exchanges heat between the heat source side refrigerant and air supplied from an air-sending device (not illustrated) such as a fan.

The accumulator 19 is provided at the intake of the compressor 10 and accumulates excess refrigerant due to the difference between the heating operation and the cooling operation, as well as excess refrigerant due to transitional changes in operation (for example, a change in the number of operating indoor units 2).

The first connecting pipe 4*a* connects, inside the outdoor unit 1, the refrigerant pipe that connects the first refrigerant flow switching device 11 and the check valve 13*d* described later to the refrigerant pipe that connects the refrigerant pipe 4 circulating heat source side refrigerant out of the outdoor unit 1 and the check valve 13*a* described later.

The second connecting pipe 4*b* connects, inside the outdoor unit 1, the refrigerant pipe that connects the refrigerant pipe 4 circulating heat source side refrigerant into the outdoor unit 1 and the check valve 13*d* described later to the refrigerant pipe that connects the heat source side heat exchanger 12 and the check valve 13*a* described later.

The check valve 13*a* is provided on the refrigerant pipe that connects the heat source side heat exchanger 12 and the refrigerant pipe 4 circulating the heat source side refrigerant out of the outdoor unit 1, and causes the refrigerant to circulate only in the direction from the heat source side heat exchanger 12 to the heat medium relay unit 3.

The check valve 13*b* is provided on the first connecting pipe 4*a*, and causes heat source side refrigerant discharged from the compressor 10 during the heating operation to circulate only in the direction towards the heat medium relay unit 3.

The check valve 13*c* is provided on the second connecting pipe 4*b*, and causes the refrigerant returning from the heat medium relay unit 3 during the heating operation to circulate only in the direction towards the heat source side heat exchanger 12.

The check valve 13*d* is provided on the refrigerant pipe that connects the first refrigerant flow switching device 11 and the refrigerant pipe 4 circulating heat source side refrigerant into the outdoor unit 1, and causes the refrigerant to circulate only in the direction from that refrigerant pipe 4 to the first refrigerant flow switching device 11.

(Configuration of Indoor Units 2)

Each of the indoor units 2 respectively includes a use side heat exchanger 26. The four indoor units 2 illustrated in FIG. 2 are designated the indoor unit 2*a*, the indoor unit 2*b*, the indoor unit 2*c*, and the indoor unit 2*d* starting from the bottom of FIG. 2, and will be simply designated the indoor units 2 when not being respectively distinguished. Additionally, the four use side heat exchangers 26 illustrated in FIG. 2 are designated the use side heat exchanger 26*a*, the use side heat exchanger 26*b*, the use side heat exchanger 26*c*, and the use side heat exchanger 26*d* starting from the bottom of FIG. 2 in correspondence with the indoor units 2*a* to 2*d*, and will be simply designated the use side heat exchangers 26 when not being respectively distinguished.

The use side heat exchangers 26 are respectively connected by heat medium pipes to the heat medium pipes 5 that flows the heat medium flowing out of the heat medium relay unit 3 as well as the heat medium pipes 5 that flows the heat medium flowing out of the indoor units 2. In addition, the heat source side heat exchangers 26 function as radiators (gas coolers) during the heating operation, function as evaporators during the cooling operation, exchange heat between the heat medium and indoor air supplied from an air-sending device (not illustrated) such as a fan, and generate heated air or cooled air to supply to the indoor space 7.

Note that, similarly to FIG. 1, the number of connected indoor units 2 is not limited to the four units illustrated in FIG. 2, and may be one unit or multiple units.

(Configuration of Heat Medium Relay Unit 3)

The heat medium relay unit 3 includes two heat exchangers related to heat medium 15, two expansion devices 16, two opening and closing devices 17, two second refrigerant flow switching devices 18, two pumps 21, four first heat medium flow switching devices 22, four second heat medium flow switching devices 23, four heat medium flow control devices 25, a concentration detecting device 39, a shutoff valve driving device 40, and a computing device 41.

Also, in Embodiment 1 the heat medium relay unit 3 includes a first shutoff device 37 and a second shutoff device 38 capable of shutting off the passage through the refrigerant pipe connections to the outdoor unit 1.

The two heat exchangers related to heat medium 15 function as radiators or evaporators, exchanging heat with heat source side refrigerant and heat medium, and transferring cooling energy or heating energy generated by the outdoor unit 1 and stored in the heat source side refrigerant to the heat medium. Herein, the two heat exchangers related to heat medium 15 illustrated in FIG. 2 are respectively designated the heat exchanger related to heat medium 15*a* and the heat exchanger related to heat medium 15*b*, and will be simply designated the heat exchangers related to heat medium 15 when not being respectively distinguished. Of these, the heat exchanger related to heat medium 15*a* is provided between the expansion device 16*a* and the second refrigerant flow switching device 18*a* on the refrigerant circuit A, serving to heat the heat medium during the heating only operating mode described later, and serving to cool the heat medium during the cooling only operating mode, the cooling main operating mode, and the heating main operating mode described later. Additionally, the heat exchanger related to heat medium 15*b* is provided between the expansion device 16*b* and the second refrigerant flow switching device 18*b* on the refrigerant circuit A, serving to cool the heat medium during the cooling only operating mode described later, and serving to heat the heat medium during the heating only operating mode, the cooling main operating mode, and the heating main operating mode described later.

The two expansion devices 16 have the function of a pressure-reducing or expansion valve on the refrigerant circuit A, depressurize the heat source side refrigerant to expand. Herein, the two expansion devices 16 illustrated in FIG. 2 are respectively designated the expansion device 16*a* and the expansion device 16*b*, and will be simply designated the expansion devices 16 when not being respectively distinguished. Of these, the expansion device 16*a* has one end connected to the heat exchanger related to heat medium 15*a* so as to be on the upstream side of the heat exchanger related to heat medium 15*a* with respect to the flow of the heat source side refrigerant during the cooling only operating mode, while the other end is connected to the opening and closing device 17*a*. Meanwhile, the expansion device 16*b* has one end connected to the heat exchanger related to heat medium 15*b* so as to be on the upstream side of the heat exchanger related to heat medium 15*b* with respect to the flow of the heat source side refrigerant during the cooling only operating mode, while the other end is connected to the opening and closing device 17*a*. The expansion devices 16 also have variably controllable opening degrees, and may include electronic expansion valves or the like, for example.

The two opening and closing devices 17 include two-way valves or the like, opening and closing the refrigerant pipes on the refrigerant circuit A. Herein, the two opening and closing devices 17 illustrated in FIG. 2 are respectively designated the opening and closing device 17*a* and the opening and closing device 17*b*, and will be simply designated the opening and closing devices 17 when not being respectively distinguished. Of these, the opening and closing device 17*a* has one end connected to the refrigerant pipe 4 that flows heat source side refrigerant into the heat medium relay unit 3, while the other end is connected to the expansion device 16*a* and the expansion device 16*b*. Meanwhile, the opening and closing device 17*b* has one end connected to the refrigerant pipe 4 that flows heat source side refrigerant out of the heat medium relay unit 3, while the other end is connected to the port of the opening and closing device 17*a* on the side connected to the expansion devices 16.

The two second refrigerant flow switching devices 18 include four-way valves or the like, switching the flow of heat source side refrigerant on the refrigerant circuit A according to the operating mode. Herein, the two second refrigerant flow switching devices 18 illustrated in FIG. 2 are respectively designated the second refrigerant flow switching device 18*a* and the second refrigerant flow switching device 18*b*, and will be simply designated the second refrigerant flow switching devices 18 when not being respectively distinguished. Of these, the second refrigerant flow switching device 18*a* is provided on the downstream side of the heat exchanger related to heat medium 15*a* with respect to the flow of the heat source side refrigerant during the cooling only operating mode. Meanwhile, the second refrigerant flow switching device 18*b* is provided on the downstream side of the heat exchanger related to heat medium 15*b* with respect to the flow of the heat source side refrigerant during the cooling only operating mode.

The two pumps 21 circulate the heat medium by pressure through the heat medium circuit B. Herein, the two pumps 21 illustrated in FIG. 2 are respectively designated the pump 21*a* and the pump 21*b*, and will be simply designated the pumps 21 when not being respectively distinguished. Of these, the pump 21*a* is provided on a heat medium pipe between the heat exchanger related to heat medium 15*a* and the second heat medium flow switching devices 23. Meanwhile, the pump 21*b* is provided on a heat medium pipe between the heat exchanger related to heat medium 15*b* and the second heat medium flow switching devices 23. The pumps 21 may also include variable-capacity pumps or the like, for example.

However, the pump 21*a* may also be configured to be provided on a heat medium pipe between the heat exchanger related to heat medium 15*a* and the first heat medium flow switching devices 22. Likewise, the pump 21*b* may also be configured to be provided on a heat medium pipe between the heat exchanger related to heat medium 15*b* and the first heat medium flow switching devices 22.

The four first heat medium flow switching devices 22 include three-way valves or the like, switching the heat medium flow on the heat medium circuit B according to the operating mode. The four first heat medium flow switching devices 22 illustrated in FIG. 2 are designated the first heat medium flow switching device 22*a*, the first heat medium flow switching device 22*b*, the first heat medium flow switching device 22*c*, and the first heat medium flow switching device 22*d* starting from the bottom of FIG. 2 in correspondence with the indoor units 2*a* to 2*d*. Additionally, the number of first heat medium flow switching devices 22 provided corresponds to the number of installed indoor units 2 (four in FIG. 2). Also, of the three ends of the first heat medium flow switching devices 22, one end is connected to the heat exchanger related to heat medium 15*a*, another end to the heat exchanger related to heat medium 15*b*, and the remaining end to the heat medium flow control devices 25, respectively, accepting the inflow of heat medium flowing out of the use side heat exchangers 26 via the heat medium pipes 5 and the heat medium flow control devices 25.

The four second heat medium flow switching devices 23 include three-way valves or the like, switching the heat medium flow on the heat medium circuit B according to the operating mode. The four second heat medium flow switching devices 23 illustrated in FIG. 2 are designated the second heat medium flow switching device 23*a*, the second heat medium flow switching device 23*b*, the second heat medium flow switching device 23*c*, and the second heat medium flow switching device 23*d* starting from the bottom of FIG. 2 in correspondence with the indoor units 2*a* to 2*d*, and will be simply designated the second heat medium flow switching devices 23 when not being respectively distinguished. Additionally, the number of second heat medium flow switching devices 23 provided corresponds to the number of installed indoor units 2 (four in FIG. 2). Also, of the three ends of the second heat medium flow switching devices 23, one end is connected to the pump 21*a*, another end to the pump 21*b*, and the remaining end to the use side heat exchangers 26 via the heat medium pipes 5, respectively.

The heat medium flow control devices 25 include two-way valves or the like capable of controlling the port surface area, controlling the flow rate of heat medium flowing through the use side heat exchangers 26 (heat medium pipes 5) on the heat medium circuit B. The four heat medium flow control devices 25 illustrated in FIG. 2 are designated the heat medium flow control device 25*a*, the heat medium flow control device 25*b*, the heat medium flow control device 25*c*, and the heat medium flow control device 25*d* starting from the bottom of FIG. 2 in correspondence with the indoor units 2*a* to 2*d*, and will be simply designated the heat medium flow control devices 25 when not being respectively distinguished. Meanwhile, the number of heat medium flow control devices 25 provided corresponds to the number of installed indoor units 2 (four in FIG. 2). Also, the heat medium flow control devices 25 have one end connected to heat medium pipes 5 that flows the heat medium flowing out from the use side heat exchangers 26 of the indoor units 2 into the heat medium relay unit 3, and the other end connected to the first heat medium flow switching devices 22, respectively.

Note that although the heat medium flow control devices 25 are installed in the heat medium pipe system on the outlet side of the heat medium flow paths of the use side heat exchangers 26 as above, the configuration is not limited thereto, and the heat medium flow control devices 25 may also be installed in the heat medium pipe system on the inlet side of the use side heat exchangers 26 (for example, between the second heat medium flow switching devices 23 and the heat medium pipes 5 that flows the heat medium flowing out of the heat medium relay unit 3 into the use side heat exchangers 26 of the indoor units 2).

The heat medium relay unit 3 is additionally provided with two first temperature sensors 31, four second temperature sensors 34, four third temperature sensors 35, a pressure sensor 36, and a concentration detecting device 39. Information detected by these sensors and the like (temperature information, pressure information, and concentration information) is transmitted to a controller (not illustrated) that controls the operation of the air-conditioning apparatus 100. The controller includes a microcomputer or the like, and on the basis of the detected information and operation information from a remote control or the like, controls the driving frequency of the compressor 10, the rotation speed of fans (not illustrated) provided in the heat source side heat exchanger 12 and the use side heat exchangers 26, the refrigerant flow switching by the first refrigerant flow switching device 11 and the second refrigerant flow switching devices 18, the driving frequency of the pumps 21, the heat medium flow switching by the first heat medium flow switching devices 22 and the second heat medium flow switching devices 23, the heat medium flow rate of the heat medium flow control devices 25, as well as the gating action of the first shutoff device 37 and the second shutoff device 38, implementing the various operating modes described later. In addition, by controlling the heat medium flow paths of the first heat medium flow switching devices 22 and the second heat medium flow switching devices 23, the controller can selectively control whether to circulate the heat medium from the heat exchanger related to heat medium 15*a* into the use side heat exchangers 26, or circulate the heat medium from the heat exchanger related to heat medium 15*b* into the use side heat exchangers 26. In other words, by controlling the heat medium flow paths of the first heat medium flow switching devices 22 and the second heat medium flow switching devices 23, the controller can selectively communicate the inflow side flow paths and the outflow side flow paths of the use side heat exchangers 26 between the heat exchanger related to heat medium 15*a* and the heat exchanger related to heat medium 15*b*.

Note that the controller may be provided in every indoor unit 2, or alternatively, provided in the outdoor unit 1 or the heat medium relay unit 3.

The two first temperature sensors 31 detect the temperature of the heat medium flowing out of the heat exchangers related to heat medium 15, or in other words, the heat medium at the heat medium outlets of the heat exchangers related to heat medium 15, and may include thermistors or the like, for example. Herein, the two first temperature sensors 31 illustrated in FIG. 2 include a first temperature sensor 31*a* and a first temperature sensor 31*b*, and will be simply designated the first temperature sensors 31 when not being respectively distinguished. Of these, the first temperature sensor 31*a* is provided on the heat medium pipe at the inlet of the pump 21*a*. Meanwhile, the first temperature sensor 31*b* is provided on the heat medium pipe at the inlet of the pump 21*b*.

The four second temperature sensors 34 are provided between the first heat medium flow switching devices 22 and the heat medium flow control devices 25 and detect the temperature of the heat medium flowing out of the use side heat exchangers 26, and may include thermistors or the like, for example. The four second temperature sensors 34 illustrated in FIG. 2 are designated the second temperature sensor 34*a*, the second temperature sensor 34*b*, the second temperature sensor 34*c*, and the second temperature sensor 34*d* starting from the bottom of FIG. 2 in correspondence with the indoor units 2*a* to 2*d*, and will be simply designated the second temperature sensors 34 when not being respectively distinguished. Additionally, the number of second temperature sensors 34 provided corresponds to the number of installed indoor units 2 (four in FIG. 2).

The third temperature sensor 35*a* and the third temperature sensor 35*c* are respectively installed between the heat exchangers related to heat medium 15 and the second refrigerant flow switching devices 18 and detect the temperature of refrigerant flowing into or out of the heat exchangers related to heat medium 15, and may include thermistors or the like, for example. Further, the third temperature sensor 35*b* and the third temperature sensor 35*d* are respectively installed between the heat exchangers related to heat medium 15 and the expansion devices 16 and detect the temperature of refrigerant flowing into or out of the heat exchangers related to heat medium 15, and may include thermistors or the like, for example. Herein, the third temperature sensor 35*a*, the third temperature sensor 35*b*, the third temperature sensor 35*c*, and the third temperature sensor 35*d* illustrated in FIG. 2 will be simply designated by the third temperature sensors 35 when not being respectively distinguished. The third temperature sensor 35*a* is provided between the heat exchanger related to heat medium 15*a* and the second refrigerant flow switching device 18*a*. Also, the third temperature sensor 35*b* is provided between the heat exchanger related to heat medium 15*a* and the expansion device 16*a*. Also, the third temperature sensor 35*c* is provided between the heat exchanger related to heat medium 15*b* and the second refrigerant flow switching device 18*b*. Further, the third temperature sensor 35*d* is provided between the heat exchanger related to heat medium 15*b* and the expansion device 16*b*.

The pressure sensor 36 is provided between the heat exchanger related to heat medium 15*b* and the expansion device 16*b*, similarly to the installation position of the third temperature sensor 35*d*, and detects the pressure of refrigerant flowing between the heat exchanger related to heat medium 15*b* and the expansion device 16*b*.

The concentration detecting device 39 detects the concentration of refrigerant inside the heat medium relay unit 3. Note that the relative connections and operation of the first shutoff device 37, the second shutoff device 38, the concentration detecting device 39, the shutoff valve driving device 40, and the computing device 41 will be described later with FIG. 7.

In an air-conditioning apparatus 100 according to Embodiment 1 configured as above, heat is exchanged between the refrigerant circulating through a refrigerant circuit A and heat medium circulating through a heat medium circuit B by a heat exchanger related to heat medium 15*a* and a heat exchanger related to heat medium 15*b*.

Next, the respective operating modes implemented by the air-conditioning apparatus 100 will be described. The air-conditioning apparatus 100 is capable of implementing the cooling operation or the heating operation with respective indoor units 2, on the basis of instructions from each of the indoor units 2. In other words, the air-conditioning apparatus 100 is configured such that all indoor units 2 may operate identically, but also such that each of the indoor units 2 may operate differently.

The operating modes implemented by the air-conditioning apparatus 100 include a cooling only operating mode in which all indoor units 2 being driven to implement the cooling operation, a heating only operating mode in which all indoor units 2 being driven to implement the heating operation, a cooling main operating mode in which the cooling load is larger, and a heating main operating mode in which the heating load is larger. Hereinafter, the respective operating modes will be described together with the flows of heat source side refrigerant and heat medium.

(Cooling Only Operating Mode)

Figure 3:
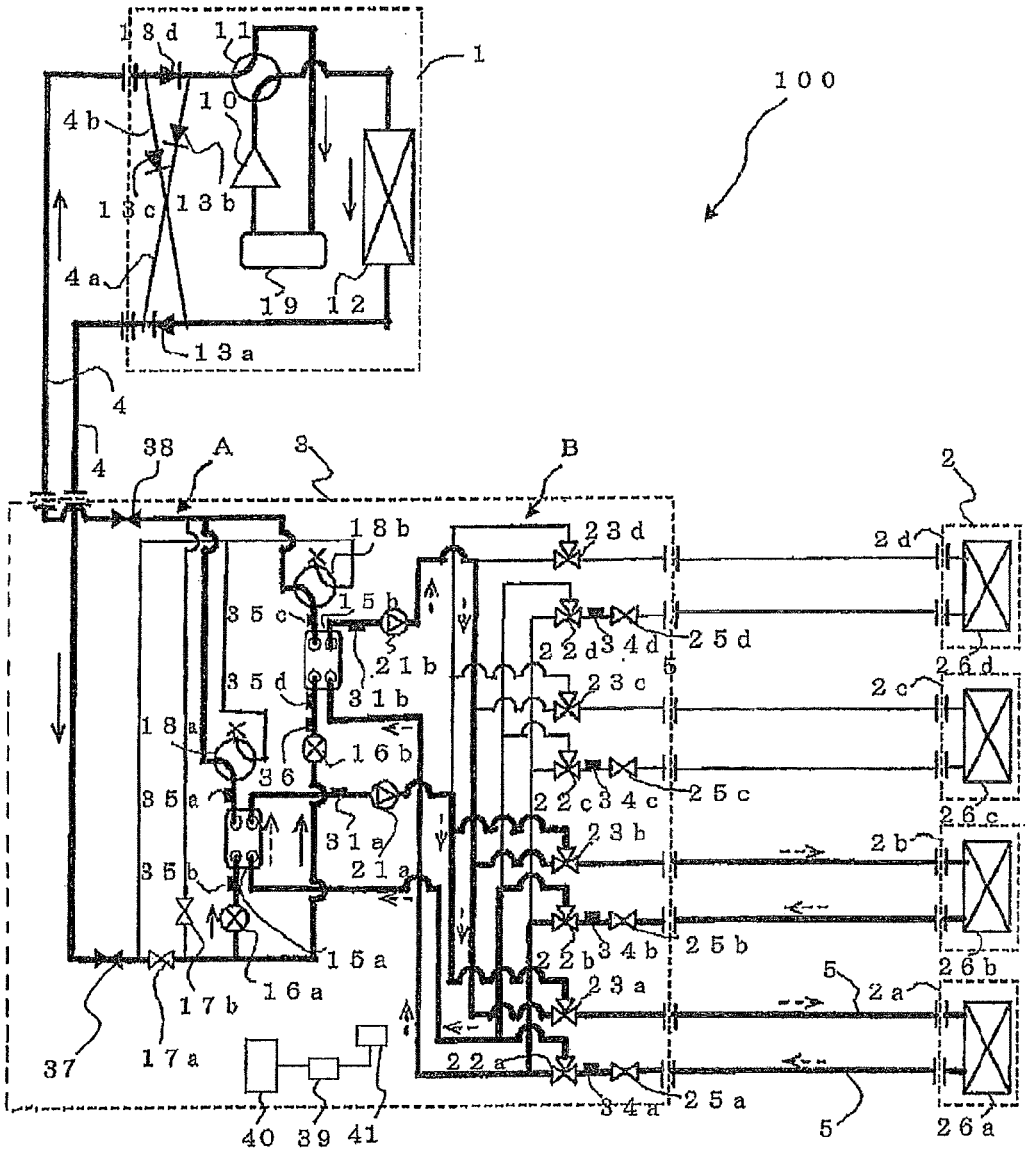
FIG. 3 is a refrigerant circuit diagram illustrating the flow of heat source side refrigerant during a cooling only operating mode of the air-conditioning apparatus 100 according to Embodiment 1 of the present invention.

FIG. 3 is a refrigerant circuit diagram illustrating the flow of heat source side refrigerant during a cooling only operating mode of the air-conditioning apparatus 100 according to Embodiment 1 of the present invention. The cooling only operating mode will be described with FIG. 3, taking as an example the case where a cooling load is generated by the use side heat exchanger 26*a* and the use side heat exchanger

26*b* only. Note that in FIG. 3, pipes indicated by the thick lines represent pipes through which the heat source side refrigerant and the heat medium flow, while solid-line arrows represent the direction of heat source side refrigerant flow and broken-line arrows represent the direction of heat medium flow.

In the case of the cooling only operating mode illustrated in FIG. 3, the controller causes the first refrigerant flow switching device 11 to switch the refrigerant flow path in the outdoor unit 1 to circulate the heat source side refrigerant discharged from the compressor 10 into the heat source side heat exchanger 12. In addition, the controller performs opening and closing control to put the opening and closing device 17*a* in an open state and the opening and closing device 17*b* in a closed state. Then, in the heat medium relay unit 3, the controller drives the pump 21*a* and the pump 21*b*, opens the heat medium flow control device 25*a* and the heat medium flow control device 25*b*, and closes the heat medium flow control device 25*c* and the heat medium flow control device 25*d*, causing heat medium to circulate between each of the heat exchanger related to heat medium 15*a* and the heat exchanger related to heat medium 15*b*, and the use side heat exchanger 26*a* and the use side heat exchanger 26*b*, respectively.

First, the flow of heat source side refrigerant in the refrigerant circuit A will be described with reference to FIG. 3. The heat source side refrigerant in a low temperature and low pressure gaseous state is compressed by the compressor 10 to become the heat source side refrigerant in a high temperature and high pressure gaseous state, and is discharged. The high temperature and high pressure heat source side refrigerant discharged from the compressor 10 flows into the heat source side heat exchanger 12 via the first refrigerant flow switching device 11. The heat source side refrigerant flowing into the heat source side heat exchanger 12 becomes the heat source side refrigerant in a high pressure liquid state while radiating heat to the outdoor air. The high pressure heat source side refrigerant flowing out of the heat source side heat exchanger 12 flows out of the outdoor unit 1 through the check valve 13*a*, and flows into the heat medium relay unit 3 via the refrigerant pipes 4.

After passing through the first shutoff device 37 and the opening and closing device 17*a*, the high pressure heat source side refrigerant flowing into the heat medium relay unit 3 splits and respectively flows into the expansion device 16*a* and the expansion device 16*b*. The high pressure heat source side refrigerant flowing into the expansion device 16*a* and the expansion device 16*b* is expanded and decompressed to become a low temperature and low pressure two-phase gas-liquid heat source side refrigerant. The two-phase gas-liquid heat source side refrigerant respectively flows into the heat exchanger related to heat medium 15*a* and the heat exchanger related to heat medium 15*b* which act as evaporators, and evaporates to become the heat source side refrigerant in a low temperature and low pressure gaseous state while cooling the heat medium by absorbing heat from the heat medium circulating through the heat medium circuit B. The gaseous heat source side refrigerant flowing out of the heat exchanger related to heat medium 15*a* and the heat exchanger related to heat medium 15*b* converges via the second refrigerant flow switching device 18*a* and the second refrigerant flow switching device 18*b*, respectively, flows out of the heat medium relay unit 3 via the second shutoff device 38, and once again flows into the outdoor unit 1 via the refrigerant pipes 4.

The gaseous heat source side refrigerant flowing into the outdoor unit 1 passes through the check valve 13*d* and is once again suctioned into the compressor 10 via the first refrigerant flow switching device 11 and the accumulator 19.

At this point, the controller controls the opening degree of the expansion device 16*a* such that the superheat (degree of superheat) obtained as the difference between the temperature detected by the third temperature sensor 35*a* and the temperature detected by the third temperature sensor 35*b* becomes constant. Similarly, the controller controls the opening degree of the expansion device 16*b* such that the superheat obtained as the difference between the temperature detected by the third temperature sensor 35*c* and the temperature detected by the third temperature sensor 35*d* becomes constant.

Next, the flow of heat medium in the heat medium circuit B will be described with reference to FIG. 3. In the cooling only operating mode, the cooling energy of the heat source side refrigerant is transferred to the heat medium in both the heat exchanger related to heat medium 15*a* and the heat exchanger related to heat medium 15*b*, and the cooled heat medium is circulated through the heat medium circuit B by the pump 21*a* and the pump 21*b*.

The heat medium pressurized by and flowing out of the pump 21*a* and the pump 21*b* flows out of the heat medium relay unit 3 via the second heat medium flow switching device 23*a* and the second heat medium flow switching device 23*b*, and respectively flows into the indoor unit 2*a* and the indoor unit 2*b* via the heat medium pipes 5. At this point, since the heat medium flow control device 25*c* and the heat medium flow control device 25*d* are fully closed, the heat medium does not flow into the respective indoor unit 2*c* and the indoor unit 2*d* via the second heat medium flow switching device 23*c* and the second heat medium flow switching device 23*d*.

The heat medium flowing into the indoor unit 2*a* and the indoor unit 2*b* respectively flows into the use side heat exchanger 26*a* and the use side heat exchanger 26*b*. The heat medium flowing into the use side heat exchanger 26*a* and the use side heat exchanger 26*b* absorbs heat from the indoor air, thereby cooling the indoor space 7. Then, the heat medium flowing out of the use side heat exchanger 26*a* and the use side heat exchanger 26*b* respectively flows out of the indoor unit 2*a* and the indoor unit 2*b*, and flows into the heat medium relay unit 3 via the heat medium pipes 5.

The heat medium flowing into the heat medium relay unit 3 flows into the heat medium flow control device 25*a* and the heat medium flow control device 25*b*. At this point, the heat medium is made to flow into the use side heat exchanger 26*a* and the use side heat exchanger 26*b* at a flow rate controlled by the action of the heat medium flow control device 25*a* and the heat medium flow control device 25*b*, this flow rate being the flow rate of heat medium necessary to cover the air conditioning load required indoors. The heat medium flowing out of the heat medium flow control device 25*a* respectively flows into the heat exchanger related to heat medium 15*a* and the heat exchanger related to heat medium 15*b* via the first heat medium flow switching device 22*a*. Similarly, heat medium flowing out of the heat medium flow control device 25*b* respectively flows into the heat exchanger related to heat medium 15*a* and the heat exchanger related to heat medium 15*b* via the first heat medium flow switching device 22*b*. The heat medium flowing into the heat exchanger related to heat medium 15*a* and the heat exchanger related to heat medium 15*b* is once again respectively suctioned into the pump 21*a* and the pump 21*b*. At this point, the first heat medium flow switching device 22*a* and the first heat medium flow switching device 22*b* are set to intermediate opening degrees to maintain flows flowing into both the heat exchanger related to heat medium 15*a* and the heat exchanger related to heat medium 15*b*.

In addition, the air conditioning load required in the indoor space 7 may be covered by keeping the difference between the temperature detected by the first temperature sensor 31*a* or the temperature detected by the first temperature sensor 31*b* and the temperature detected by the second temperature sensors 34 at a target value.

Also, although the cooling operation by the use side heat exchangers 26 should ideally be controlled according to the inlet and the outlet temperature difference, the heat medium temperature at the outlet of the use side heat exchangers 26 is nearly the same temperature as the temperature detected by the first temperature sensors 31, and thus using the first temperature sensors 31 enables a reduction in the number of temperature sensors to constitute a system at lower cost. Note that the temperature of either the first temperature sensor 31*a* or the first temperature sensor 31*b* may be used as the outlet temperature of the heat exchangers related to heat medium 15, or alternatively, their average temperature may be used.

In the case of implementing the above cooling only operating mode, it is not necessary for heat medium to flow to use side heat exchangers 26 with no heat load (include those switched off by thermostat control). For this reason, heat medium is made to not flow to the use side heat exchangers 26 by closing flows with the heat medium flow control devices 25. In FIG. 3, heat medium is flowing through the use side heat exchanger 26*a* and the use side heat exchanger 26*b* because a heat load exists, but since there is no heat load on the use side heat exchanger 26*c* and the use side heat exchanger 26*d*, the heat medium flow control device 25*c* and the heat medium flow control device 25*d* are fully closed. Furthermore, in the case where a heat load is generated from the use side heat exchanger 26*c* or the use side heat exchanger 26*d*, the heat medium flow control device 25*c* or the heat medium flow control device 25*d* may be opened to allow the circulation of heat medium. Note that this mode is similarly applicable to the other operating modes.

(Heating Only Operating Mode)

Figure 4:
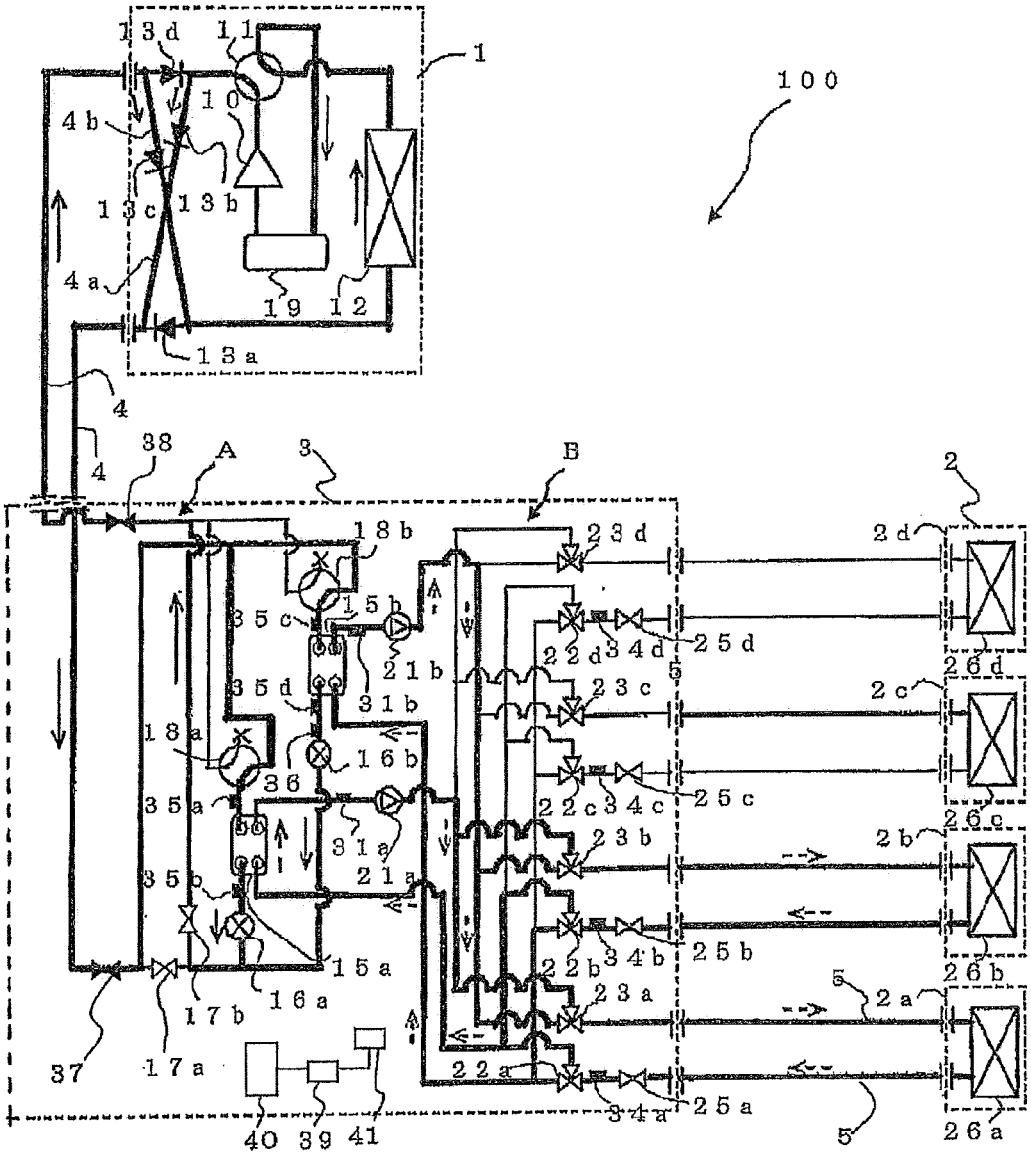
FIG. 4 is a refrigerant circuit diagram illustrating the flow of heat source side refrigerant during a heating only operating mode of the air-conditioning apparatus 100 according to Embodiment 1 of the present invention.

FIG. 4 is a refrigerant circuit diagram illustrating the flow of heat source side refrigerant during a heating only operating mode of the air-conditioning apparatus 100 according to Embodiment 1 of the present invention. The heating only operating mode will be described with FIG. 4, taking as an example of the case where a heating load is generated by the use side heat exchanger 26*a* and the use side heat exchanger 26*b* only. Note that in FIG. 4, pipes indicated by the thick lines represent pipes through which the heat source side refrigerant and the heat medium flow, while solid-line arrows represent the direction of heat source side refrigerant flow and broken-line arrows represent the direction of heat medium flow.

In the case of the heating only operating mode illustrated in FIG. 4, the controller causes the first refrigerant flow switching device 11 to switch the refrigerant flow path in the outdoor unit 1 to circulate the heat source side refrigerant discharged from the compressor 10 into the heat medium relay unit 3, without passing through the heat source side heat exchanger 12. In addition, the controller performs opening and closing control to put the opening and closing device 17*a* in a closed state and the opening and closing device 17*b* in an open state. Then, in the heat medium relay unit 3, the controller drives the pump 21*a* and the pump 21*b*, opens the heat medium flow control device 25*a* and the heat medium flow control device 25*b*, and closes the heat medium flow control device 25*c* and the heat medium flow control device 25*d*, causing heat medium to circulate between each of the heat exchanger related to heat medium 15*a* and the heat exchanger related to heat medium 15*b*, and the use side heat exchanger 26*a* and the use side heat exchanger 26*b*, respectively.

First, the flow of heat source side refrigerant in the refrigerant circuit A will be described with reference to FIG. 4. The heat source side refrigerant in a low temperature and low pressure gaseous state is compressed by the compressor 10 to become the heat source side refrigerant in a high temperature and high pressure gaseous state, and is discharged. The high temperature and high pressure heat source side refrigerant discharged from the compressor 10 passes through the check valve 13*b* in the first connecting pipe 4*a* via the first refrigerant flow switching device 11, and flows out of the outdoor unit 1. The high temperature and high pressure heat source side refrigerant flowing out of the outdoor unit 1 flows into the heat medium relay unit 3 via the refrigerant pipes 4.

The high temperature and high pressure heat source side refrigerant flowing into the heat medium relay unit 3 splits after passing through the first shutoff device 37, and respectively flows, via the second refrigerant flow switching device 18*a* and the second refrigerant flow switching device 18*b*, into the heat exchanger related to heat medium 15*a* and the heat exchanger related to heat medium 15*b* which act as condensers. The high temperature and high pressure heat source side refrigerant flowing into the heat exchanger related to heat medium 15*a* and the heat exchanger related to heat medium 15*b* condenses to become the heat source side refrigerant in a high pressure liquid state while heating the heat medium by radiating heat to the heat medium circulating through the heat medium circuit B. The high pressure heat source side refrigerant flowing out of the heat exchanger related to heat medium 15*a* and the heat exchanger related to heat medium 15*b* is respectively expanded and decompressed by the expansion device 16*a* and the expansion device 16*b* to become a low temperature and low pressure two-phase gas-liquid heat source side refrigerant. The low temperature and low pressure two-phase gas-liquid heat source side refrigerant converges, flows out of the heat medium relay unit 3 via the opening and closing device 17*b* and the second shutoff device 38, and once again flows into the outdoor unit 1 via the refrigerant pipes 4.

The two-phase gas-liquid heat source side refrigerant flowing into the outdoor unit 1 passes through the check valve 13*c* in the second connecting pipe 4*b* and flows into the heat source side heat exchanger 12. The two-phase gas-liquid heat source side refrigerant flowing into the heat source side heat exchanger 12 evaporates while absorbing heat from the outdoor air, and becomes the heat source side refrigerant in a low temperature and low pressure gaseous state. The gaseous heat source side refrigerant flowing out of the heat source side heat exchanger 12 is once again suctioned into the compressor 10 via the first refrigerant flow switching device 11 and the accumulator 19.

At this point, the controller controls the opening degree of the expansion device 16*a* such that the subcooling (degree of subcooling) obtained as the difference between the temperature detected by the third temperature sensor 35*b* and a value obtained by converting the pressure detected by the pressure sensor 36 into a saturation temperature becomes constant. Similarly, the controller controls the opening degree of the expansion device 16*b* such that the subcooling obtained as the difference between the temperature detected by the third temperature sensor 35*d* and a value obtained by converting the pressure detected by the pressure sensor 36 into a saturation temperature becomes constant.

Note that in the case where the temperature at an intermediate position between heat exchangers related to heat medium 15 can be measured, the temperature at that intermediate position may be used instead of the pressure sensor 36. In this case, the system can be configured at lower cost.

Next, the flow of heat medium in the heat medium circuit B will be described with reference to FIG. 4. In the heating only operating mode, the heating energy of the heat source side refrigerant is transferred to the heat medium in both the heat exchanger related to heat medium 15*a* and the heat exchanger related to heat medium 15*b*, and the heated heat medium is circulated through the heat medium circuit B by the pump 21*a* and the pump 21*b*.

The heat medium pressurized by and flowing out of the pump 21*a* and the pump 21*b* flows out of the heat medium relay unit 3 via the second heat medium flow switching device 23*a* and the second heat medium flow switching device 23*b*, and respectively flows into the indoor unit 2*a* and the indoor unit 2*b* via the heat medium pipes 5. At this point, since the heat medium flow control device 25*c* and the heat medium flow control device 25*d* are fully closed, the heat medium does not flow into the respective indoor unit 2*c* and the indoor unit 2*d* via the second heat medium flow switching device 23*c* and the second heat medium flow switching device 23*d*.

The heat medium flowing into the indoor unit 2*a* and the indoor unit 2*b* respectively flows into the use side heat exchanger 26*a* and the use side heat exchanger 26*b*. The heat medium flowing into the use side heat exchanger 26*a* and the use side heat exchanger 26*b* radiates heat to the indoor unit air, thereby heating the indoor space 7. Then, the heat medium flowing out of the use side heat exchanger 26*a* and the use side heat exchanger 26*b* respectively flows out of the indoor unit 2*a* and the indoor unit 2*b*, and flows into the heat medium relay unit 3 via the heat medium pipes 5.

The heat medium flowing into the heat medium relay unit 3 flows into the heat medium flow control device 25*a* and the heat medium flow control device 25*b*. At this point, the heat medium is made to flow into the use side heat exchanger 26*a* and the use side heat exchanger 26*b* at a flow rate controlled by the action of the heat medium flow control device 25*a* and the heat medium flow control device 25*b*, this flow rate being the flow rate of heat medium necessary to cover the air conditioning load required indoors. The heat medium flowing out of the heat medium flow control device 25*a* respectively flows into the heat exchanger related to heat medium 15*a* and the heat exchanger related to heat medium 15*b* via the first heat medium flow switching device 22*a*. Similarly, the heat medium flowing out of the heat medium flow control device 25*b* respectively flows into the heat exchanger related to heat medium 15*a* and the heat exchanger related to heat medium 15*b* via the first heat medium flow switching device 22*b*. The heat medium flowing into the heat exchanger related to heat medium 15*a* and the heat exchanger related to heat medium 15*b* is once again respectively suctioned into the pump 21*a* and the pump 21*b*. At this point, the first heat medium flow switching device 22*a* and the first heat medium flow switching device 22*b* are set to intermediate opening degrees to maintain flows flowing into both the heat exchanger related to heat medium 15*a* and the heat exchanger related to heat medium 15*b*.

In addition, the air conditioning load required in the indoor space 7 may be covered by keeping the difference between the temperature detected by the first temperature sensor 31*a* or the temperature detected by the first temperature sensor 31*b* and the temperature detected by the second temperature sensors 34 at a target value. Also, although the heating operation by the use side heat exchangers 26 should ideally be controlled according to the inlet and the outlet temperature difference, the heat medium temperature at the outlet of the use side heat exchangers 26 is nearly the same temperature as the temperature detected by the first temperature sensors 31, and thus using the first temperature sensors 31 enables a reduction in the number of temperature sensors to constitute a system at lower cost. Note that the temperature of either the first temperature sensor 31*a* or the first temperature sensor 31*b* may be used as the outlet temperature of the heat exchangers related to heat medium 15, or alternatively, their average temperature may be used.

(Cooling Main Operating Mode)

Figure 5:
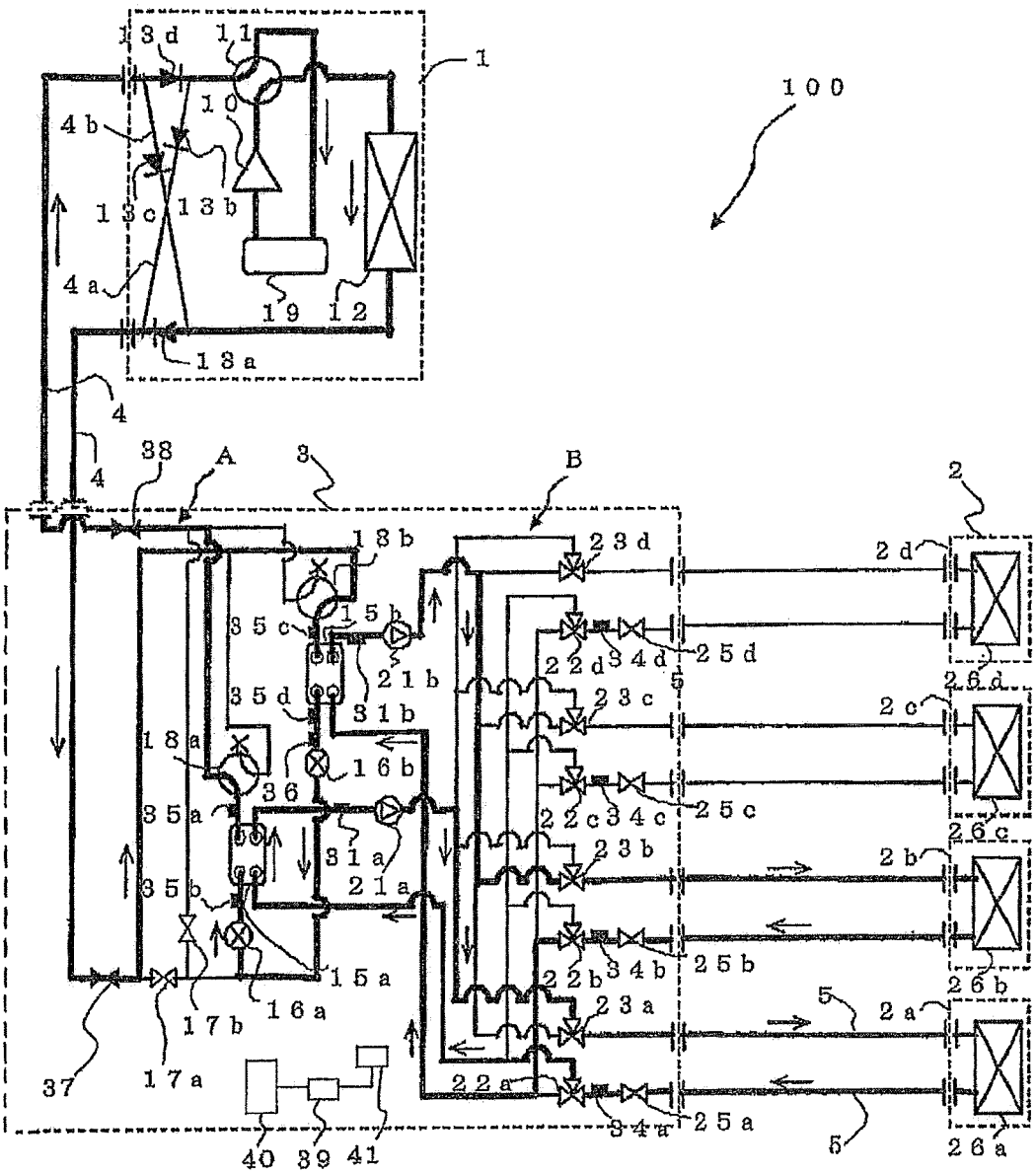
FIG. 5 is a refrigerant circuit diagram illustrating the flow of heat source side refrigerant during a cooling main operating mode of the air-conditioning apparatus 100 according to Embodiment 1 of the present invention.

FIG. 5 is a refrigerant circuit diagram illustrating the flow of heat source side refrigerant during a cooling main operating mode of the air-conditioning apparatus 100 according to Embodiment 1 of the present invention. The cooling main operating mode will be described with FIG. 5, taking as an example the case where a cooling load is generated by the use side heat exchanger 26*a*, and a heating load is generated by the use side heat exchanger 26*b*. Note that in FIG. 5, pipes indicated by the thick lines represent pipes through which the heat source side refrigerant and the heat medium flow, while solid-line arrows represent the direction of heat source side refrigerant flow and broken-line arrows represent the direction of heat medium flow.

In the case of the cooling main operating mode illustrated in FIG. 5, the controller causes the first refrigerant flow switching device 11 to switch the refrigerant flow path in the outdoor unit 1 to circulate the heat source side refrigerant discharged from the compressor 10 into the heat source side heat exchanger 12. In addition, the controller performs opening and closing control to put the expansion device 16*a* in a fully open state, and to put the opening and closing device 17*a* and the opening and closing device 17*b* in a closed state. Then, in the heat medium relay unit 3, the controller drives the pump 21*a* and the pump 21*b*, opens the heat medium flow control device 25*a* and the heat medium flow control device 25*b*, and closes the heat medium flow control device 25*c* and the heat medium flow control device 25*d*, causing heat medium to respectively circulate between the heat exchanger related to heat medium 15*a* and the use side heat exchanger 26*a*, and between the heat exchanger related to heat medium 15*b* and the use side heat exchanger 26*b*.

First, the flow of heat source side refrigerant in the refrigerant circuit A will be described with reference to FIG. 5. The heat source side refrigerant in a low temperature and low pressure gaseous state is compressed by the compressor 10 to become the heat source side refrigerant in a high temperature and high pressure gaseous state, and is discharged. The high temperature and high pressure heat source side refrigerant discharged from the compressor 10 flows into the heat source side heat exchanger 12 via the first refrigerant flow switching device 11. The heat source side refrigerant flowing into the heat source side heat exchanger 12 becomes the heat source side refrigerant at a lowered temperature while radiating heat to the outdoor air. The heat source side refrigerant flowing out of the heat source side heat exchanger 12 flows out of the outdoor unit 1 through the check valve 13*a*, and flows into the heat medium relay unit 3 via the refrigerant pipes 4.

The heat source side refrigerant flowing into the heat medium relay unit 3 flows, via the first shutoff device 37 and the second refrigerant flow switching device 18*b*, into the heat exchanger related to heat medium 15*b* which serves as a condenser. The heat source side refrigerant flowing into the heat exchanger related to heat medium 15*b* condenses to become the heat source side refrigerant in a liquid state at a further lowered temperature while heating the heat medium by radiating heat to the heat medium circulating through the heat medium circuit B. The liquid heat source side refrigerant flowing out of the heat exchanger related to heat medium 15*b* is expanded and decompressed by the expansion device 16*b* to become a low temperature and low pressure two-phase gas-liquid heat source side refrigerant. The two-phase gas-liquid heat source side refrigerant flows, via the expansion device 16*a*, into the heat exchanger related to heat medium 15*a* which serves as an evaporator. The two-phase gas-liquid heat source side refrigerant flowing into the heat exchanger related to heat medium 15*a* evaporates to become the heat source side refrigerant in a low temperature and low pressure gaseous state while cooling the heat medium by absorbing heat from the heat medium circulating through the heat medium circuit B. The gaseous heat source side refrigerant flowing out of the heat exchanger related to heat medium 15*a* flows out of the heat medium relay unit 3 via the second refrigerant flow switching device 18*a* and the second shutoff device 38, and once again flows into the outdoor unit 1 via the refrigerant pipes 4.

The gaseous heat source side refrigerant flowing into the outdoor unit 1 passes through the check valve 13*d* and is once again suctioned into the compressor 10 via the first refrigerant flow switching device 11 and the accumulator 19.

At this point, the controller controls the opening degree of the expansion device 16*b* such that the superheat obtained as the difference between the temperature detected by the third temperature sensor 35*a* and the temperature detected by the third temperature sensor 35*b* becomes constant.

Note that the controller may also control the opening degree of the expansion device 16*b* such that the subcooling obtained as the difference between the temperature detected by the third temperature sensor 35*d* and a value obtained by converting the pressure detected by the pressure sensor 36 into a saturation temperature becomes constant.

The controller may also fully open the expansion device 16*b* and control the above superheat or subcooling with the expansion device 16*a*.

Next, the flow of heat medium in the heat medium circuit B will be described with reference to FIG. 5. In the cooling main operating mode, the heating energy of the heat source side refrigerant is transferred to the heat medium in the heat exchanger related to heat medium 15*b*, and the heated heat medium is circulated through the heat medium circuit B by the pump 21*b*. Also, in the cooling main operating mode, the cooling energy of the heat source side refrigerant is transferred to the heat medium in the heat exchanger related to heat medium 15*a*, and the cooled heat medium is circulated through the heat medium circuit B by the pump 21*a*.

The heat medium pressurized by and flowing out of the pump 21*b* flows out of the heat medium relay unit 3 via the second heat medium flow switching device 23*b*, and flows into the indoor unit 2*b* via the heat medium pipes 5. The heat medium pressurized by and flowing out of the pump 21*a* flows out of the heat medium relay unit 3 via the second heat medium flow switching device 23*a*, and flows into the indoor unit 2*a* via the heat medium pipes 5. At this point, since the heat medium flow control device 25*c* and the heat medium flow control device 25*d* are fully closed, the heat medium does not flow into the respective indoor unit 2*c* and the indoor unit 2*d* via the second heat medium flow switching device 23*c* and the second heat medium flow switching device 23*d*.

The heat medium flowing into the indoor unit 2*b* flows into the use side heat exchanger 26*b*, while heat medium flowing into the indoor unit 2*a* flows into the use side heat exchanger 26*a*. The heat medium flowing into the use side heat exchanger 26*b* radiates heat to the indoor air, thereby heating the indoor space 7. Meanwhile, the heat medium flowing into the use side heat exchanger 26*a* absorbs heat from the indoor air, thereby cooling the indoor space 7. Then, the heat medium flowing out of the use side heat exchanger 26*b* at a somewhat lowered temperature flows out of the indoor unit 2*b*, and flows into the heat medium relay unit 3 via the heat medium pipes 5. Meanwhile, the heat medium flowing out of the use side heat exchanger 26*a* at a somewhat raised temperature flows out of the indoor unit 2*a*, and flows into the heat medium relay unit 3 via the heat medium pipes 5.

The heat medium flowing into the heat medium relay unit 3 from the use side heat exchanger 26*b* flows into the heat medium flow control device 25*b*, while the heat medium flowing into the heat medium relay unit 3 from the use side heat exchanger 26*a* flows into the heat medium flow control device 25*a*. At this point, the heat medium is made to flow into the use side heat exchanger 26*a* and the use side heat exchanger 26*b* at a flow rate controlled by the action of the heat medium flow control device 25*a* and the heat medium flow control device 25*b*, this flow rate being the flow rate of heat medium necessary to cover the air conditioning load required indoors. The heat medium flowing out of the heat medium flow control device 25*b* flows into the heat exchanger related to heat medium 15*b* via the first heat medium flow switching device 22*b*, and is once again suctioned into the pump 21*b*. Meanwhile, heat medium flowing out of the heat medium flow control device 25*a* flows into the heat exchanger related to heat medium 15*a* via the first heat medium flow switching device 22*a*, and is once again suctioned into the pump 21*a*. As above, in the cooling main operating mode, the warm heat medium and the cool heat medium flow into use side heat exchangers 26 having a heating load and a cooling load, respectively, and due to the action of the first heat medium flow switching devices 22 and the second heat medium flow switching devices 23, the heat medium does not mix.

In addition, the air conditioning load required in the indoor space 7 may be covered by keeping the difference between the temperature detected by the first temperature sensor 31*b* and the temperature detected by the second temperature sensor 34*b* at a target value on the heating side, while keeping the difference between the temperature detected by the second temperature sensor 34*a* and the temperature detected by the first temperature sensor 31*a* at a target value on the cooling side.

(Heating Main Operating Mode)

Figure 6:
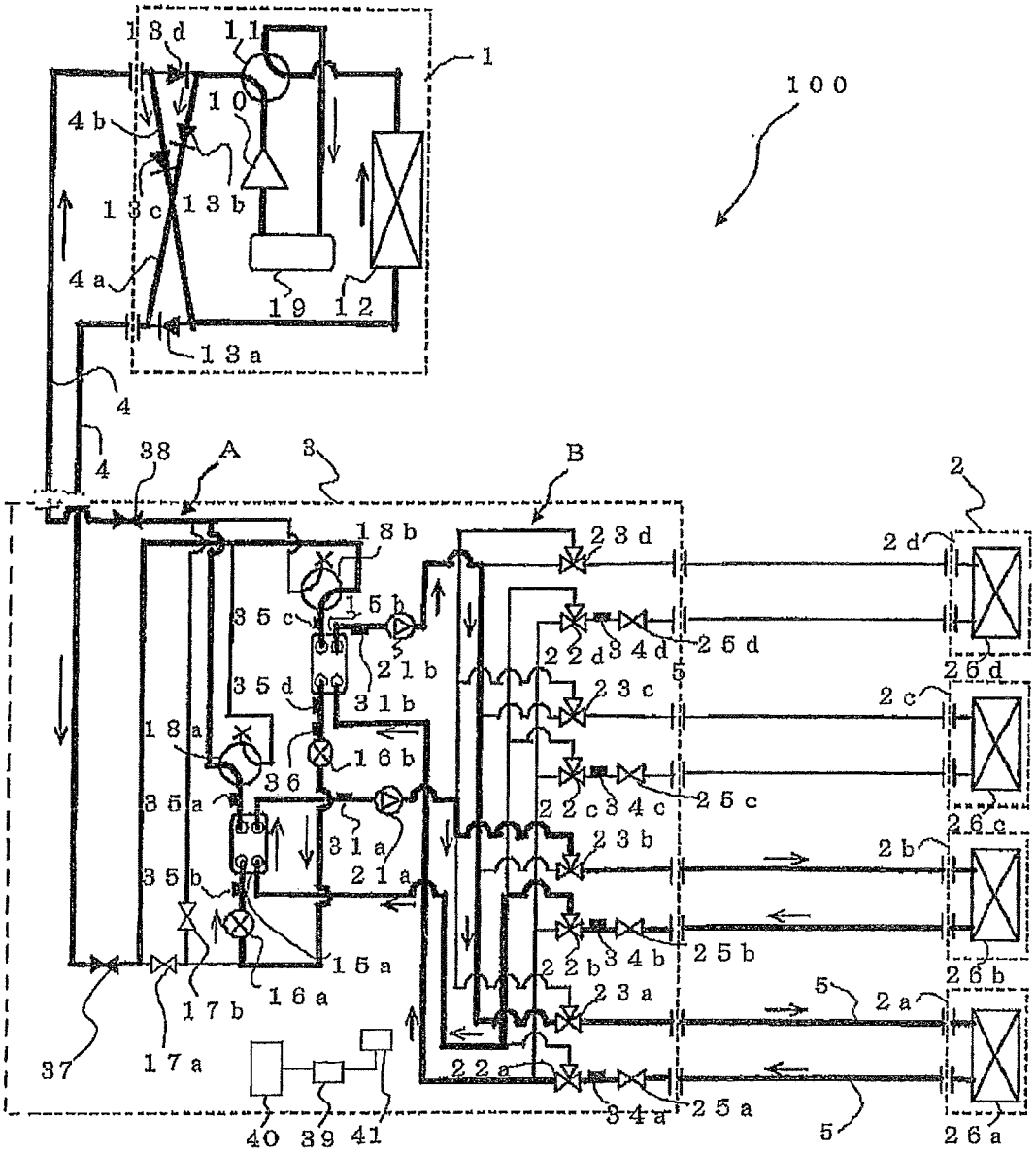
FIG. 6 is a refrigerant circuit diagram illustrating the flow of heat source side refrigerant during a heating main operating mode of the air-conditioning apparatus 100 according to Embodiment 1 of the present invention.

FIG. 6 is a refrigerant circuit diagram illustrating the flow of heat source side refrigerant during a heating main operating mode of the air-conditioning apparatus 100 according to Embodiment 1 of the present invention. The heating main operating mode will be described with FIG. 6, taking as an example the case where a heating load is generated by the use side heat exchanger 26*a*, and a cooling load is generated by the use side heat exchanger 26*b*. Note that in FIG. 6, pipes indicated by the thick lines represent pipes through which the heat source side refrigerant and the heat medium flow, while solid-line arrows represent the direction of heat source side refrigerant flow and broken-line arrows represent the direction of heat medium flow.

In the case of the heating main operating mode illustrated in FIG. 6, the controller causes the first refrigerant flow switching device 11 to switch the refrigerant flow path in the outdoor unit 1 to circulate the heat source side refrigerant discharged from the compressor 10 into the heat medium relay unit 3, without passing through the heat source side heat exchanger 12. In addition, the controller performs opening and closing control to put the expansion device 16*a* in a fully open state, and to put the opening and closing device 17*a* in a closed state and the opening and closing device 17*b* in a closed state. Then, in the heat medium relay unit 3, the controller drives the pump 21*a* and the pump 21*b*, opens the heat medium flow control device 25*a* and the heat medium flow control device 25*b*, and closes the heat medium flow control device 25*c* and the heat medium flow control device 25*d*, causing heat medium to respectively circulate between the heat exchanger related to heat medium 15*a* and the use side heat exchanger 26*a*, and between the heat exchanger related to heat medium 15*b* and the use side heat exchanger 26*b*.

First, the flow of heat source side refrigerant in the refrigerant circuit A will be described with reference to FIG. 6. The heat source side refrigerant in a low temperature and low pressure gaseous state is compressed by the compressor 10 to become the heat source side refrigerant in a high temperature and high pressure gaseous state, and is discharged. The high temperature and high pressure heat source side refrigerant discharged from the compressor 10 passes through the check valve 13*b* in the first connecting pipe 4*a* via the first refrigerant flow switching device 11, and flows out of the outdoor unit 1. The high temperature and high pressure heat source side refrigerant flowing out of the outdoor unit 1 flows into the heat medium relay unit 3 via the refrigerant pipes 4.

The high temperature and high pressure heat source side refrigerant flowing into the heat medium relay unit 3 flows, via the first shutoff device 37 and the second refrigerant flow switching device 18*b*, into the heat exchanger related to heat medium 15*b* which serves as a condenser. The high temperature and high pressure heat source side refrigerant flowing into the heat exchanger related to heat medium 15*b* condenses to become the heat source side refrigerant in a liquid state while heating the heat medium by radiating heat to the heat medium circulating through the heat medium circuit B. The liquid heat source side refrigerant flowing out of the heat exchanger related to heat medium 15*b* is expanded and decompressed by the expansion device 16*b* to become a low temperature and low pressure two-phase gas-liquid heat source side refrigerant. The two-phase gas-liquid heat source side refrigerant flows, via the expansion device 16*a*, into the heat exchanger related to heat medium 15*a* which serves as an evaporator. The two-phase gas-liquid heat source side refrigerant flowing into the heat exchanger related to heat medium 15*a* cools the heat medium by absorbing heat from the heat medium circulating through the heat medium circuit B. The two-phase gas-liquid heat source side refrigerant flowing out of the heat exchanger related to heat medium 15*a* flows out of the heat medium relay unit 3 via the second refrigerant flow switching device 18*a* and the second shutoff device 38, and once again flows into the outdoor unit 1 via the refrigerant pipes 4.

The two-phase gas-liquid heat source side refrigerant flowing into the outdoor unit 1 passes through the check valve 13*c* in the second connecting pipe 4*b* and flows into the heat source side heat exchanger 12. The two-phase gas-liquid heat source side refrigerant flowing into the heat source side heat exchanger 12 evaporates while absorbing heat from the outdoor air, and becomes the heat source side refrigerant in a low temperature and low pressure gaseous state. The gaseous heat source side refrigerant flowing out of the heat source side heat exchanger 12 is once again suctioned into the compressor 10 via the first refrigerant flow switching device 11 and the accumulator 19.

At this point, the controller controls the opening degree of the expansion device 16*b* such that the subcooling obtained as the difference between the temperature detected by the third temperature sensor 35*b* and a value obtained by converting the pressure detected by the pressure sensor 36 into a saturation temperature becomes constant.

Note that the controller may also fully open the expansion device 16*b* and control the above subcooling with the expansion device 16*a*.

Next, the flow of heat medium in the heat medium circuit B will be described with reference to FIG. 6. In the heating main operating mode, the heating energy of the heat source side refrigerant is transferred to the heat medium in the heat exchanger related to heat medium 15*b*, and the heated heat medium is circulated through the heat medium circuit B by the pump 21*b*. Also, in the heating main operating mode, the cooling energy of the heat source side refrigerant is transferred to the heat medium in the heat exchanger related to heat medium 15*a*, and the cooled heat medium is circulated through the heat medium circuit B by the pump 21*a*.

The heat medium pressurized by and flowing out of the pump 21*b* flows out of the heat medium relay unit 3 via the second heat medium flow switching device 23*a*, and flows into the indoor unit 2*a* via the heat medium pipes 5. The heat medium pressurized by and flowing out of the pump 21*b* flows out of the heat medium relay unit 3 via the second heat medium flow switching device 23*b*, and flows into the indoor unit 2*b* via the heat medium pipes 5. At this point, since the heat medium flow control device 25*c* and the heat medium flow control device 25*d* are fully closed, the heat medium does not flow into the respective indoor unit 2*c* and the indoor unit 2*d* via the second heat medium flow switching device 23*c* and the second heat medium flow switching device 23*d*.

The heat medium flowing into the indoor unit 2*b* flows into the use side heat exchanger 26*b*, while the heat medium flowing into the indoor unit 2*a* flows into the use side heat exchanger 26*a*. The heat medium flowing into the use side heat exchanger 26*b* absorbs heat from the indoor air, thereby cooling the indoor space 7. Meanwhile, the heat medium flowing into the use side heat exchanger 26*a* radiates heat to the indoor air, thereby heating the indoor space 7. Then, the heat medium flowing out of the use side heat exchanger 26*b* at a somewhat raised temperature flows out of the indoor unit 2*b*, and flows into the heat medium relay unit 3 via the heat medium pipes 5. Meanwhile, the heat medium flowing out of the use side heat exchanger 26*a* at a somewhat lowered temperature flows out of the indoor unit 2*a*, and flows into the heat medium relay unit 3 via the heat medium pipes 5.

The heat medium flowing into the heat medium relay unit 3 from the use side heat exchanger 26*b* flows into the heat medium flow control device 25*b*, while the heat medium flowing into the heat medium relay unit 3 from the use side heat exchanger 26*a* flows into the heat medium flow control device 25*a*. At this point, the heat medium is made to flow into the use side heat exchanger 26*a* and the use side heat exchanger 26*b* at a flow rate controlled by the action of the heat medium flow control device 25*a* and the heat medium flow control device 25*b*, this flow rate being the flow rate of heat medium necessary to cover the air conditioning load required indoors. The heat medium flowing out of the heat medium flow control device 25*b* flows into the heat exchanger related to heat medium 15*a* via the first heat medium flow switching device 22*b*, and is once again suctioned into the pump 21*a*. Meanwhile, heat medium flowing out of the heat medium flow control device 25*a* flows into the heat exchanger related to heat medium 15*b* via the first heat medium flow switching device 22*a*, and is once again suctioned into the pump 21*b*. As above, in the heating main operating mode, the warm heat medium and the cool heat medium flow into use side heat exchangers 26 having a heating load and a cooling load, respectively, and due to the action of the first heat medium flow switching devices 22 and the second heat medium flow switching devices 23, the heat medium does not mix.

In addition, the air conditioning load required in the indoor space 7 may be covered by keeping the difference between the temperature detected by the first temperature sensor 31*b* and the temperature detected by the second temperature sensor 34*a* at a target value on the heating side, while keeping the difference between the temperature detected by the second temperature sensor 34*b* and the temperature detected by the first temperature sensor 31*a* at a target value on the cooling side.

In the above cooling main operating mode and heating main operating mode, a change in the operating state of the heat exchanger related to heat medium 15*a* and the heat exchanger related to heat medium 15*b* (the heating operation or the cooling operation of the heat medium) causes previously warm heat medium to cool and become cool heat medium, alternatively, causes previously cool heat medium to become warm heat medium, thus generating excess energy. Thus, the air-conditioning apparatus 100 according to Embodiment 1 is configured such that the heat exchanger related to heat medium 15*b* is always on the heating side and the heat exchanger related to heat medium 15*a* is always on the cooling side in both the cooling main operating mode and the heating main operating mode.

Also, in the case where the use side heat exchangers 26 generate a mixed heating load and cooling load in the cooling main operating mode and the heating main operating mode as above, the first heat medium flow switching devices 22 and the second heat medium flow switching devices 23 corresponding to the use side heat exchangers 26 implementing heating switch to a flow connected to the heat exchanger related to heat medium 15*b* used to heat the heat medium, while the first heat medium flow switching devices 22 and the second heat medium flow switching devices 23 corresponding to the use side heat exchangers 26 implementing cooling switch to a flow connected to the heat exchanger related to heat medium 15*a* used to cool the heat medium. In so doing, each indoor unit 2 is able to switch freely between the heating operation and the cooling operation.

(Refrigerant Concentration Detecting Configuration in Heat Medium Relay Unit 3)

Figure 7:
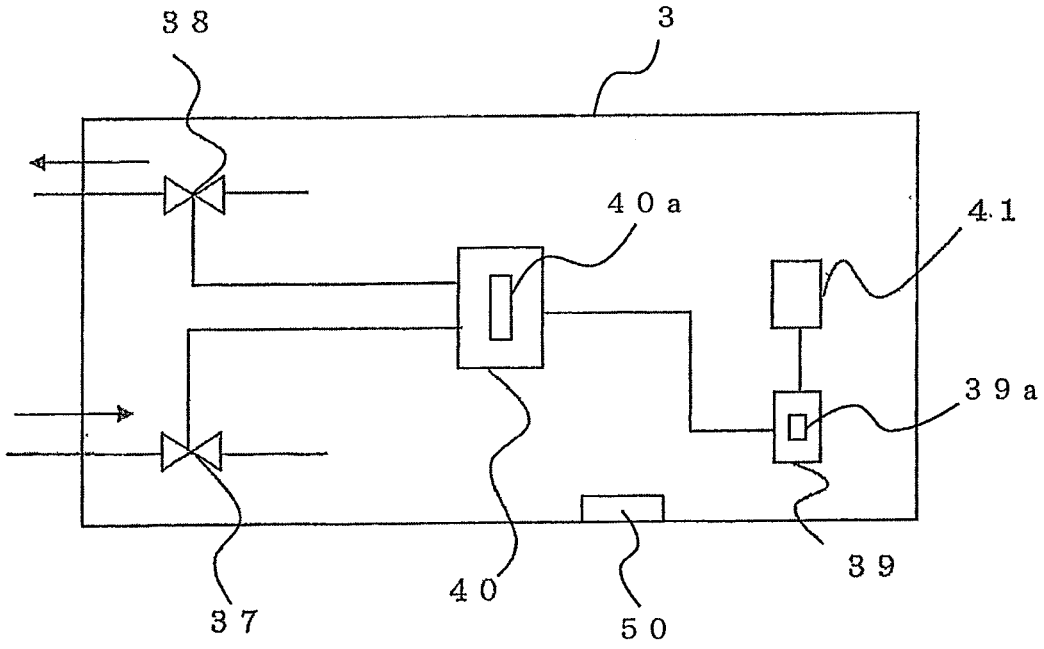
FIG. 7 is a configuration diagram related to a refrigerant concentration detection operation in a heat medium relay unit 3 of the air-conditioning apparatus 100 according to Embodiment 1 of the present invention.

FIG. 7 is a configuration diagram related to the refrigerant concentration detection operation in a heat medium relay unit 3 of the air-conditioning apparatus 100 according to Embodiment 1 of the present invention. As illustrated in FIG. 7, the heat medium relay unit 3 includes a first shutoff device 37 that flows or shuts off the heat source side refrigerant sent from the outdoor unit 1 through the heat exchanger related to heat medium 15*a* or the heat exchanger related to heat medium 15*b*, a second shutoff device 38 that flows or shuts off the heat source side refrigerant from the heat medium relay unit 3 to the outdoor unit 1, a concentration detecting device 39 that detects the concentration of heat source side refrigerant inside the heat medium relay unit 3, a shutoff valve driving device 40 that opens or closes the first shutoff device 37 and the second shutoff device 38 on the basis of a control signal from the concentration detecting device 39, and a computing device 41 that computes the concentration of heat source side refrigerant on the basis of detected information from the concentration detecting device 39. Note that the concentration detecting device 39 and the computing device 41 are equivalent to a "concentration determining device" of the present invention, while the shutoff valve driving device 40 is equivalent to a "controller" of the present invention.

The first shutoff device 37 is installed at the heat source side refrigerant inlet (high-pressure side) of the heat medium relay unit 3, entering an open state at the time of electrifying by a driving signal from the shutoff valve driving device 40, and entering a closed state when de-energized. The closed state shuts off the flow of heat source side refrigerant from the outdoor unit 1 to the heat exchanger related to heat medium 15*a* or the heat exchanger related to heat medium 15*b*.

The second shutoff device 38 is installed at the heat source side refrigerant outlet (low-pressure side) of the heat medium relay unit 3, entering an open state at the time of electrifying by a driving signal from the shutoff valve driving device 40, and entering a closed state when de-energized. The closed state shuts off the flow of heat source side refrigerant from the heat medium relay unit 3 to the outdoor unit 1.

Herein, since the first shutoff device 37 and the second shutoff device 38 are installed on the main pipes of the refrigerant circuit, it is necessary to increase the pipe diameter to increase the Cv value. Thus, the first shutoff device 37 and the second shutoff device 38 are pilot shutoff devices rather than direct operated shutoff devices. However, since the first shutoff device 37 is installed on the high-pressure side, the Cv value may be decreased to approximately Cv=2 (1 or greater) under conditions of approximately 5 hp, for example. Meanwhile, since the second shutoff device 38 is installed on the low-pressure side, it is necessary to increase the Cv value to approximately Cv=5 (5 or greater) under conditions of approximately 5 hp, for example. Herein, the Cv value is a (dimensionless) numerical value expressing, in US gal/min (1 US gal=3.785 L), the flow rate of water at a temperature of 60 degrees F. (approximately 15.5 degrees C.) flowing through a valve at a specific opening degree with a pressure differential of 1 $lb/in^2$ [6.895 kPa].

Also, the coil that opens and closes the valve body of the first shutoff device 37 and the second shutoff device 38 may be excited by a direct current (DC) voltage, for example. The operating voltage may be a value such as 12 V or 24 V, for example, although these voltage values are not limiting. Also, although a coil driven by an alternating current (AC) voltage rather than a DC voltage may also be used, a DC voltage coil has the advantage of longer life. In addition, a material such as rubber or PTFE may be used as the seal material for sealing the valve body of the first shutoff device 37 and the second shutoff device 38. The reason for not using a more durable metallic seal is because the first shutoff device 37 and the second shutoff device 38 do not open and close frequently like ordinary valves, but rather shut off flow only in emergencies as described later, and thus it is necessary to use a seal material such as rubber or PTFE, which will readily conform to the valve body.

Also, the first shutoff device 37 and the second shutoff device 38 preferably have a refrigerant leakage rate of $1.0\times10^{-6}$ [$m^3$/s] or less when in the closed state, for example. The reason for this rate will be explained below.

Large amounts of leaking refrigerant create dangers such as combustion and oxygen shortage, and for each type of refrigerant there is defined a concentration limit, which is the maximum concentration of a safely usable quantity of leaked refrigerant. The concentration limit is, for example, 0.44 [$m^3$/kg] for R410A, 0.061 [$m^3$/kg] for R32, 0.0578 [$m^3$/kg] for HFO1234yf, and 0.008 [$m^3$/kg] for propane.

Consider closing the first shutoff device 37 and the second shutoff device 38 installed on the refrigerant pipes to prevent refrigerant leakage when the refrigerant leaks indoors. At this point, adopting preventative means for preventing the leakage of refrigerant after the refrigerant reaches the concentration limit would be too late. For this reason, the first shutoff device 37 and the second shutoff device 38 are made to close when the indoor concentration of refrigerant reaches 95% of the concentration limit. In other words, after the first shutoff device 37 and the second shutoff device 38 close, an additional 5% of the refrigerant quantity may still leak before the refrigerant reaches the concentration limit.

At this point, consider the case where the expected installation location of a multi-air-conditioning system for a building is a very small room such as a single room in a hotel. Assume that the room has a volume of 25 [$m^3$], that the pressure differential across the first shutoff device 37 and the second shutoff device 38 when operated is 1.0 [MPa], and that the effective volume of the indoor space after subtracting the bathroom and other objects is $0.5\times25=12.5$ [$m^3$]. In this case, the quantity of refrigerant that may still leak after closing the first shutoff device 37 and the second shutoff device 38 becomes 12.5 [$m^3$]$\times0.05=0.625$ [$m^3$]. Since it is conceivable that an occupant may be in a sealed space with windows closed without becoming aware of the refrigerant leakage, such as while sleeping, computing a leakage rate that does not reach the concentration limit within 24 hours after the first shutoff device 37 and the second shutoff device 38 operate yields $0.625/(24\cdot60\cdot60)=7.2\cdot10^{-6}$ [$m^3$/s]. If the leakage rate after closing the first shutoff device 37 and the second shutoff device 38 is less than this value, the leakage is safe.

Furthermore, since the site where the refrigerant is leaking is unknown and may be on a high-pressure pipe or a liquid-carrying pipe. Assume that the refrigerant is leaking from a high-pressure pipe and that the above leakage rate must be guaranteed for a pressure differential of approximately 5 [MPa]. From the commonly known Bernoulli's principle from fluid dynamics, the refrigerant leakage rate is proportional to the square root of the pressure differential, and thus the refrigerant leakage rate becomes $7.2\cdot10^{-6}$ [$m^3$/s]$/(5/1)^{0.5}=3.2\cdot10^{-6}$. The leakage rate is safe if less than this value. Thus, for additional safety, assume that the leakage rate is to be kept to $1.0\cdot10^{-6}$ [$m^3$/s] or less.

Note that the first shutoff device 37 and the second shutoff device 38 may have a minimum operating pressure differential of 0 [kgf/$cm^2$], for example.

In addition, given that the shutting off the refrigerant circuit is demanded at the time of emergency, the minimum operating pressure differential of the first shutoff device 37 and the second shutoff device 38 must be a sufficiently small value of approximately 0 [kPa].

The concentration detecting device 39 detects the concentration of leaked heat source side refrigerant in the case where a leak of heat source side refrigerant from a refrigerant pipe occurs inside the heat medium relay unit 3. The concentration detecting device 39 is connected to the shutoff valve driving device 40 and the computing device 41, and transmits detected information related to concentration (such as a resistance value) to the computing device 41. The concentration detecting device 39 does not output a control signal to the shutoff valve driving device 40 in the case where a concentration computed by the computing device 41 on the basis of the detected information is equal to or greater than a predetermined concentration, but does output a control signal when less than a predetermined temperature. Herein, a detecting unit 39*a* of the concentration detecting device 39 is made up of a semiconductor such as tin oxide ($SnO_2$) whose electrical resistance is configured to change according to the concentration of heat source side refrigerant, for example.

Herein a DC voltage in the range from 1 V to 24 V, such as a DC voltage 5 V, 12 V, or 24 V, for example, is output as a control signal.

However, the control signal is not limited to being a voltage, and a current may also be output.

Also, the predetermined concentration mentioned above may be approximately 1/10 the leakage concentration limit of carbon dioxide in the case of using carbon dioxide as the heat source side refrigerant, and approximately 1/10 the lower explosive limit in the case of using a combustible refrigerant as the heat source side refrigerant (such as HFO1234yf, HFO1234ze, R32, refrigerant mixtures containing R32 and HFO1234yf, refrigerant mixtures containing at least one of the above refrigerants as a component, and HC). Herein, the leakage concentration limit refers to a limit value for refrigerant concentration that may be implemented by emergency measures without harming the human body when refrigerant leaks into the air. The value of the leakage concentration limit differs for each refrigerant.

Note that although the concentration detecting device 39 may be installed inside the heat medium relay unit 3 as illustrated in FIG. 7, the configuration is not limited thereto, and the concentration detecting device 39 may also be installed close to the heat medium relay unit 3 in a location enabling the detection of refrigerant leaks from the heat medium relay unit 3.

The shutoff valve driving device 40 is connected to the first shutoff device 37 and the second shutoff device 38 in order to output a driving signal, and is additionally connected to the concentration detecting device 39 in order to receive a control signal. In the case of receiving a control signal from the concentration detecting device 39, the shutoff valve driving device 40 outputs a driving signal to the first shutoff device 37 and the second shutoff device 38 to put them in the open state. In the case of not receiving a control signal, the concentration detecting device 39 does not output a driving signal to the first shutoff device 37 and the second shutoff device 38 to put them in the closed state. The shutoff valve driving device 40 may also use a relay, or switching component, in order to receive a control signal from the concentration detecting device 39 and output a driving signal to the first shutoff device 37 and the second shutoff device 38, for example. However, in the case of using a combustible refrigerant as the heat source side refrigerant (such as HFO1234yf, R32, or HC), a mechanically-drive contacts relay may produce sparks due to the mechanical contact, thus risking ignition of the combustible refrigerant. Thus, a contactless relay 40*a* such as a solid-state relay (SSR) using semiconductor devices may be used. By using a contactless relay 40*a*, there is no mechanical contacting operation, and thus relay operation can be safely implemented without producing sparks even if combustible refrigerant leaks inside the heat medium relay unit 3.

The computing device 41 computes the concentration of heat source side refrigerant on the basis of detected information related to concentration detected by the concentration detecting device 39 (such as a resistance value), and transmits the concentration information to the concentration detecting device 39.

(Refrigerant Flow Shutoff Operation in Heat Medium Relay Unit 3)

Figure 8:
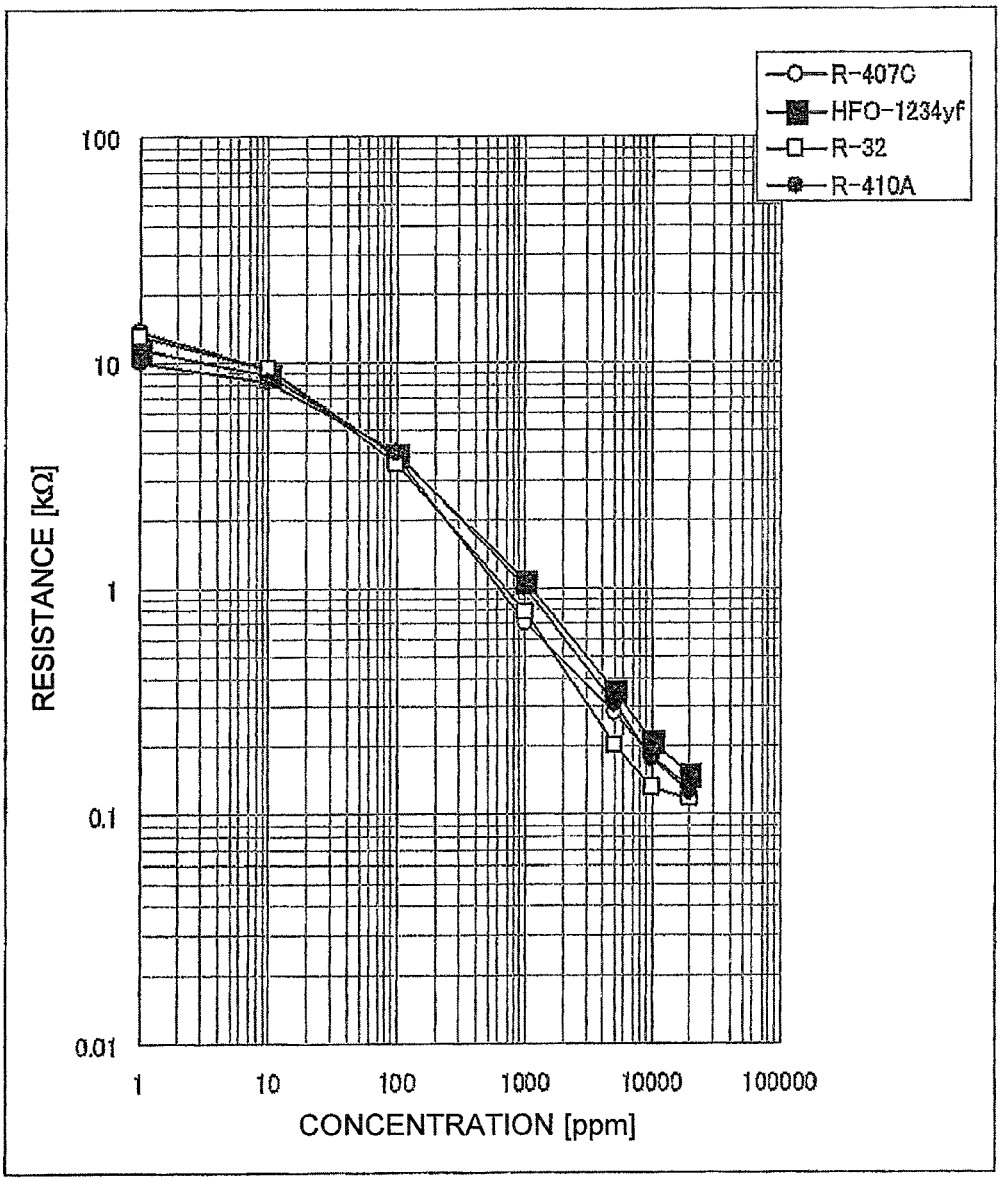
FIG. 8 is a diagram of the relationship between the refrigerant concentration and the resistance value of a detecting unit in a concentration detecting device 39 of the air-conditioning apparatus 100 according to an embodiment of the present invention.

FIG. 8 is a diagram of the relationship between refrigerant concentration and the resistance value of a detecting unit in the concentration detecting device 39 of the air-conditioning apparatus 100 according to Embodiment 1 of the present invention. FIG. 8 illustrates an example of the case of using tin oxide ($SnO_2$) as the semiconductor constituting the detecting unit of the concentration detecting device 39. Hereinafter, the refrigerant flow shutoff operation in the heat medium relay unit 3 will be described with reference to FIGS. 7 and 8.

First, assume that the air-conditioning apparatus 100 is running in any of the operating modes illustrated in FIGS. 3 to 6 described earlier. At this point, assume that a leak of heat source side refrigerant occurs in a refrigerant pipe in the heat medium relay unit 3 due to refrigerant pipe damage or a crack in a connecting portion between refrigerant pipes, for example.

The concentration detecting device 39 detects the refrigerant concentration inside the heat medium relay unit 3, and more specifically detects the resistance value of the detecting unit made of a semiconductor such as tin oxide, and transmits the detected information to the computing device 41. The computing device 41 computes the concentration of heat source side refrigerant inside the heat medium relay unit 3 on the basis of the detected information thus received, and transmits the concentration information to the concentration detecting device 39. Herein, FIG. 8 illustrates relationships between the concentration of major refrigerants (R-410A, R407C, R32, and HFO1234yf) and the electrical resistance of the detecting unit in the case using tin oxide for the detecting unit in the concentration detecting device 39 (hereinafter, the curves of the relationship between concentration and electrical resistance illustrated in FIG. 8 will be designated "calibration curves"). FIG. 8 demonstrates that all calibration curves exhibit a similar tendency. In other words, it is possible to detect the concentration of multiple types of refrigerant (more specifically, the electrical resistance of the detecting unit) with the same concentration detecting means (herein, the concentration detecting device 39) and realize a concentration detecting device 39 at lower cost, which may contribute to lower costs for the air-conditioning apparatus 100 as a result. Assume that the computing device 41 includes a storage device (not illustrated), for example, and that the calibration curve information illustrated in FIG. 8 is stored in the storage device. On the basis of the stored calibration curve information, the computing device 41 computes the concentration of heat source side refrigerant in the heat medium relay unit 3 from the detected information received from the concentration detecting device 39. At this point, the information stored in the storage device as a calibration curve used to compute the concentration of heat source side refrigerant may also be the average of the respective calibration curves for major refrigerants illustrated in FIG. 8, or alternatively, a representative example from among these calibration curves. Furthermore, in order to improve the computational precision of the heat source side refrigerant concentration by the computing device 41, calibration curves individually corresponding to the major refrigerants illustrated in FIG. 8 may be stored in the storage device, with the concentration being computed on the basis of the calibration curve corresponding to the heat source side refrigerant flowing through the refrigerant circuit A.

Note that the above calibration curves are equivalent to "correlation information" of the present invention.

The chemical formula of HFO1234yf is CF3-CF=CH2. Also, the chemical formula of HFO1234ze, an isomer of HFO1234yf, is CHF2-CF=CHF, and since the chemical properties closely resemble those of HFO1234yf, the electrical resistance properties of the detecting unit in the heat medium relay unit 3 according to Embodiment 1 exhibit nearly the same properties. Consequently, the above are detectable by the concentration detecting device 39. Also, mixing R32 and HFO1234yf to improve performance yields a zeotropic refrigerant mixture, and in the case where such a refrigerant leaks, the leakage quantity is greater for R32, the lower boiling component. Since R32 reaches the concentration limit sooner than HFO1234yf, refrigerant leakage may be detected on the safe side by detecting R32.

Also, even in the case of using other refrigerant mixtures, if any of R410A, R407C, R32, HFO1234yf, and HFO1234ze is included as a component, the electrical resistance of the detecting unit in the concentration detecting device 39 will change, and thus the above will be detectable by the concentration detecting device 39. In other words, by using the concentration detecting device 39 according to Embodiment 1, refrigerant leaks of HFC, HFO, and refrigerant mixtures containing HFC and HFO can be detected.

In the case where the concentration of heat source side refrigerant according to the concentration information received from the computing device 41 is equal to or greater than the predetermined concentration described earlier, the concentration detecting device 39 does not output a control signal to the shutoff valve driving device 40. In the case where the concentration is less than the predetermined concentration, the concentration detecting device 39 does output a control signal to the shutoff valve driving device 40. In the case of not receiving a control signal from the concentration detecting device 39, the shutoff valve driving device 40 assumes that the concentration detecting device 39 has detected a heat source side refrigerant leak equal to or greater than the predetermined concentration, and stops outputting the driving signal to the first shutoff device 37 and the second shutoff device 38, and put them in the closed state. Doing so makes it possible to prevent new heat source side refrigerant from flowing into the heat medium relay unit 3 from the outdoor unit 1, and suppress further leakage of heat source side refrigerant. On the other hand, in the case of receiving a control signal from the concentration detecting device 39, the shutoff valve driving device 40 assumes that the concentration of heat source side refrigerant detected by the concentration detecting device 39 is less than the predetermined concentration, and continues outputting the driving signal to the first shutoff device 37 and the second shutoff device 38, and put them in the open state.

Note that although the first shutoff device 37 and the second shutoff device 38 are installed on refrigerant pipes inside the heat medium relay unit 3 as illustrated in FIGS. 2 to 7, the configuration is not limited thereto, and the first shutoff device 37 and second shutoff device 38 may also be provided on the refrigerant pies 4 close to the heat medium relay unit 3. In this case, since leaks of heat source side refrigerant from the refrigerant pipes 4 are anticipated, it is necessary to limit the distance of the first shutoff device 37 and the second shutoff device 38 from the heat medium relay unit 3. Provided that the distance is an installation distance L, the installation distance L must satisfy the following Eq. 1.

(heat medium relay unit connecting pipe volume [$m^3$/m]×L [m]×average refrigerant density [kg/$m^3$]/indoor volume [$m^3$])+(heat medium relay unit volume [$m^3$]×average refrigerant density [kg/$m^3$]/indoor volume [$m^3$])<leakage concentration limit [kg/$m^3$] (1)

In Eq. 1, the heat medium relay unit connecting pipe volume [$m^3$/m] refers to the pipe volume per unit length of the refrigerant pipes 4 connected to the heat medium relay unit 3, while the average refrigerant density [kg/$m^3$] refers to the average density of gaseous, liquid, or other heat source side refrigerant present inside the heat medium relay unit 3 and the refrigerant pipes 4. Also, the indoor volume [$m^3$] refers to the volume of the space 8 where the heat medium relay unit 3 is installed, while the heat medium relay unit volume [$m^3$] refers to the total volume of the refrigerant circuit, including refrigerant pipes, inside the heat medium relay unit 3. As Eq. 1 demonstrates, since the leakage concentration limit is present on the right side of the equation, the installation distance L takes a different value for every heat source side refrigerant to be used.

In addition, although the concentration detecting device 39 and the computing device 41 are separated units as illustrated in FIG. 7, the configuration is not limited thereto, and the concentration detecting device 39 and computing device 41 may also be configured as a combined unit rather than separate units.

Effects of Embodiment 1

With the above configuration and operations, the air-conditioning apparatus 100 according to Embodiment 1 is capable of precisely detecting leaks of heat source side refrigerant in or close to the heat medium relay unit 3, and on the basis of the detecting operation, carrying out measures such as shutting off the refrigerant flow to suppress further refrigerant leakage as with the first shutoff device 37 and the second shutoff device 38 above, for example, thereby greatly improving the safety of the air-conditioning apparatus 100.

Note that although the air-conditioning apparatus 100 is configured to perform the cooling operation and the heating operation in a mixed manner as with the cooling main operating mode and the heating main operating mode, the configuration is not limited thereto. For example, similar effects can be obtained even with a configuration in which the heat medium relay unit 3 includes one heat exchanger related to heat medium 15 and one expansion device 16 each, with multiple heat medium flow control devices 25 and use side heat exchangers 26 connected in parallel thereto, such that all indoor units 2 can only implement either the cooling operation or heating operation.

Also, although the heat medium flow control devices 25 are provided inside the heat medium relay unit 3 as illustrated in FIGS. 3 to 6, the configuration is not limited thereto, and the heat medium flow control devices 25 may also be built into the indoor units 2, or installed in the heat medium pipes 5 between the heat medium relay unit 3 and the indoor units 2.

Furthermore, whereas fans are typically installed in the heat source side heat exchanger 12 and the use side heat exchangers 26 to promote condensation and evaporation with blasts of air, the configuration is not limited thereto. For example, a device using a panel heater or similar component utilizing radiation may be used as the use side heat exchangers 26, while a water-cooled device may be used as the heat source side heat exchanger 12. In other words, structures able to radiate or absorb heat are sufficient as the heat source side heat exchanger 12 and the use side heat exchangers 26.

Also, although the configuration is provided with the shutoff valve driving device 40 as a device that controls the first shutoff device 37 and the second shutoff device 38, the controller (not illustrated) described earlier may be used to control the first shutoff device 37 and the second shutoff device 38 instead of the shutoff valve driving device 40, on the basis of a control signal from the concentration detecting device 39. The controller in this case is equivalent to the "controller" of the present invention.

Also, although the refrigerant flow path is shut off by putting the first shutoff device 37 and the second shutoff device 38 into a closed state in the case where the concentration detecting device 39 detects a heat source side refrigerant leak equal to or greater than a predetermined concentration as in the above refrigerant flow shutoff operation, the configuration is not limited thereto. In other words, the air-conditioning apparatus 100 may include alarm means 50, and in the case where the concentration detecting device 39 detects a heat source side refrigerant leak equal to or greater than the predetermined concentration, the controller, in addition to, or instead of, and put them in the closed state of the first shutoff device 37 and second shutoff device 38, issues an alarm indicating that a heat source side refrigerant leak has occurred. Doing so can not only improve safety but also inform users that a heat source side refrigerant leak has occurred, enabling the users to address the heat source side refrigerant leak.

The invention claimed is:

1. An air-conditioning apparatus comprising:

an outdoor unit equipped with a compressor that compresses a heat source side refrigerant, and a heat source side heat exchanger that exchanges heat between outdoor air and the heat source side refrigerant;

a heat medium relay unit equipped with a heat exchanger related to heat medium that exchanges heat between the heat source side refrigerant and a heat medium, an expansion device that depressurizes the heat source side refrigerant, and a pump that pumps the heat medium by pressure;

an indoor unit equipped with a use side heat exchanger that exchanges heat between indoor air and the heat medium;

a concentration determining device that detects and computes a refrigerant concentration; and a plurality of shutoff devices that shut off a flow of the heat source side refrigerant on the basis of the refrigerant concentration computed by the concentration determining device, wherein the compressor, the heat source side heat exchanger, a refrigerant flow path in the heat exchanger related to heat medium, and the expansion device are connected by refrigerant pipes to form a refrigerant circuit through which the heat source side refrigerant circulates, a heat medium flow path in the heat exchanger related to heat medium, the pump, and the use side heat exchanger are connected by heat medium pipes to form a heat medium circuit through which the heat medium circulates, and a leakage rate of heat source side refrigerant from each of the shutoff devices is $1.0\times10^{-6}$ [$m^3/s$] or less when the shutoff devices shut off the flow of the heat source side refrigerant, one of the shutoff devices is installed on the refrigerant pipe that flows the heat source side refrigerant into the heat medium relay unit, and another of the shutoff devices is installed on the refrigerant pipe that flows the heat source side refrigerant out of the heat medium relay unit, the concentration determining device outputs a control signal indicating whether or not the refrigerant concentration is dangerous, on the basis of the computed refrigerant concentration, a controller that outputs a driving signal to the shutoff devices to control the operation thereof, on the basis of the control signal received from the concentration determining device is provided, and the shutoff devices are installed such that the installation distance, being the distance to the heat medium relay unit, satisfies (heat medium relay unit connecting pipe volume [$m^3/m$]×installation distance [m]×average refrigerant density [$kg/m^3$]/indoor volume [$m^3$])+(heat medium relay unit volume [$m^3$]×average refrigerant density [$kg/m^3$]/indoor volume [$m^3$])<leakage concentration limit [$kg/m^3$], wherein the concentration determining device includes a detecting unit in which an electrical resistance changes in accordance with the refrigerant concentration, a concentration detecting device configured to output the control signal, and a computing device that computes the refrigerant concentration of a plurality of types of heat source side refrigerants on the basis of correlation information between a resistance value of the detecting unit and the refrigerant concentration near the detecting unit, wherein the correlation information is a calibration curve in which the higher the refrigerant concentration, the lower the resistance value becomes.

2. The air-conditioning apparatus of claim 1, wherein the detecting unit is made up of a tin oxide ($SnO_2$) semiconductor.

3. The air-conditioning apparatus of claim 1, wherein the detecting unit is capable of detecting the refrigerant concentration, even in cases where any one of R410A, R407C, R32, R-404A, HFO1234yf, HFO1234ze, refrigerant mixtures containing R32 and HFO1234yf, and refrigerant mixtures containing any one of the above refrigerants as a component, is used as the heat source side refrigerant.

4. The air-conditioning apparatus of claim 3, wherein the concentration determining device is capable of computing the refrigerant concentration on the basis of common correlation information, even in cases where any one of R410A, R407C, R32, HFO1234yf, HFO1234ze, refrigerant mixtures containing R32 and HFO1234yf, and refrigerant mixtures containing any one of the above refrigerants as a component, is used as the heat source side refrigerant.

5. The air-conditioning apparatus of claim 1, wherein each of the shutoff devices enters an open state when becomes an electrified state and enters a closed state when becomes a non-electrified state, on the basis of the driving signal from the controller.

6. The air-conditioning apparatus of claim 1, wherein the concentration determining device does not output the control signal to the controller in the case where the computed refrigerant concentration is equal to or greater than a predetermined concentration, but does output the control signal to the controller in the case where the computed refrigerant concentration is less than the predetermined concentration, the controller outputs the driving signal to the shutoff devices in the case of receiving the control signal from the concentration determining device, but does not output the driving signal to the shutoff devices in the case of not receiving the control signal, and each of the shutoff devices turns the electrified state and enters the open state in the case of receiving the driving signal from the controller, and turns the non-electrified state and enters the closed state in the case of not receiving the driving signal.

7. The air-conditioning apparatus of claim 1, wherein the controller includes a contactless relay, and the contactless relay outputs the driving signal to the shutoff devices in the case of receiving the control signal from the concentration determining device.

8. The air-conditioning apparatus of claim 1, wherein among the refrigerant pipes inside the heat medium relay unit, the one of the shutoff devices is installed in an inlet pipe portion where the heat source side refrigerant flows into the heat medium relay unit, and the other of the shutoff devices is installed in an outlet pipe portion where the heat source side refrigerant flows out of the heat medium relay unit.

9. The air-conditioning apparatus of claim 1, wherein each of the shutoff devices uses rubber or PTFE as a material sealing a valve body therein.

10. The air-conditioning apparatus of claim 1, wherein the one of the shutoff devices installed on the refrigerant pipe that flows the heat source side refrigerant into the heat medium relay unit has a Cv value of 1 or greater, and the other of the shutoff devices installed on the refrigerant pipe that flows the heat source side refrigerant out of the heat medium relay unit has a Cv value of 5 or greater.

11. The air-conditioning apparatus of claim 1, wherein a minimum operating pressure differential of each of the shutoff devices is approximately 0 [kPa].

12. The air-conditioning apparatus of claim 1, wherein a coil of each of the shutoff devices is driven by direct current (DC) voltage.

13. The air-conditioning apparatus of claim 1, further comprising:

an alarm unit;

wherein the controller causes the alarm unit to issue an alarm indicating that a leak of heat source side refrigerant from the refrigerant pipes has occurred, on the basis of the control signal received from the concentration determining device.

* * * * *